US007896212B2

(12) United States Patent
Uejima et al.

(10) Patent No.: US 7,896,212 B2
(45) Date of Patent: Mar. 1, 2011

(54) PORTABLE TYPE FASTENER DRIVING TOOL

(75) Inventors: Yasutsugu Uejima, Osaka-fu (JP); Keiji Yamakawa, Osaka-fu (JP)

(73) Assignee: JPF Works Co., Ltd., Osaka-fu (JP)

( * ) Notice: Subject to any disclaimer, the term of this patent is extended or adjusted under 35 U.S.C. 154(b) by 551 days.

(21) Appl. No.: 10/599,242

(22) PCT Filed: Mar. 30, 2005

(86) PCT No.: PCT/IB2005/000811

§ 371 (c)(1),
(2), (4) Date: Jun. 27, 2008

(87) PCT Pub. No.: WO2005/095064

PCT Pub. Date: Oct. 13, 2005

(65) Prior Publication Data

US 2008/0251559 A1 Oct. 16, 2008

(30) Foreign Application Priority Data

Mar. 31, 2004 (JP) ..... 2004-105993

(51) Int. Cl.
*B25C 1/04* (2006.01)

(52) U.S. Cl. ..... 227/136; 227/10; 227/130; 227/138

(58) Field of Classification Search ..... 227/10, 227/112, 130, 8, 136, 135, 138, 120, 137
See application file for complete search history.

(56) References Cited

U.S. PATENT DOCUMENTS

| | | | | | |
|---|---|---|---|---|---|
| 3,488,825 | A | * | 1/1970 | Lundgren | 29/813 |
| 3,688,966 | A | | 9/1972 | Perkins | |
| 4,313,552 | A | * | 2/1982 | Maurer | 227/109 |
| 4,483,474 | A | * | 11/1984 | Nikolich | 227/8 |
| 4,593,845 | A | * | 6/1986 | Andersson et al. | 227/117 |
| 5,197,646 | A | * | 3/1993 | Nikolich | 227/8 |
| 5,558,264 | A | * | 9/1996 | Weinstein | 227/10 |
| 5,794,831 | A | | 8/1998 | Velan | |

FOREIGN PATENT DOCUMENTS

| | | | |
|---|---|---|---|
| EP | 0726122 | A | 8/1996 |
| JP | 54136478 | A | 10/1979 |
| JP | 05072380 | U | 10/1993 |
| JP | 8290370 | A | 11/1996 |

* cited by examiner

*Primary Examiner*—Scott A. Smith
(74) *Attorney, Agent, or Firm*—Lowe Hauptman Ham & Berner LLP

(57) ABSTRACT

A gas combustion type coil nailer is provided with (a) a main body (1) which is provided with combustion chamber; (b) a head part (3) which is disposed on the front surface of this; and (c) a magazine 4 which is disposed on the bottom surface of the head part (3) so that it can be attached and detached easily. A coil shaped nail connecting body is loaded onto the magazine (4). The head part (3) is provided with (d) a guide tube (35) through which the rod (17) and the nail n pass; and (e) with a feed motor (47). The nail connecting body N is fed to the guide tube (35) by a feed gear which is driven by the feed motor (47). Power is supplied to the feed motor (47) from a battery. The rod (17) is driven and the nail is fed by separate motive forces so that the nail can be fed reliably without adversely affecting the accuracy and reliability of the driving capacity of the rod (17).

6 Claims, 23 Drawing Sheets

FIGURE 13
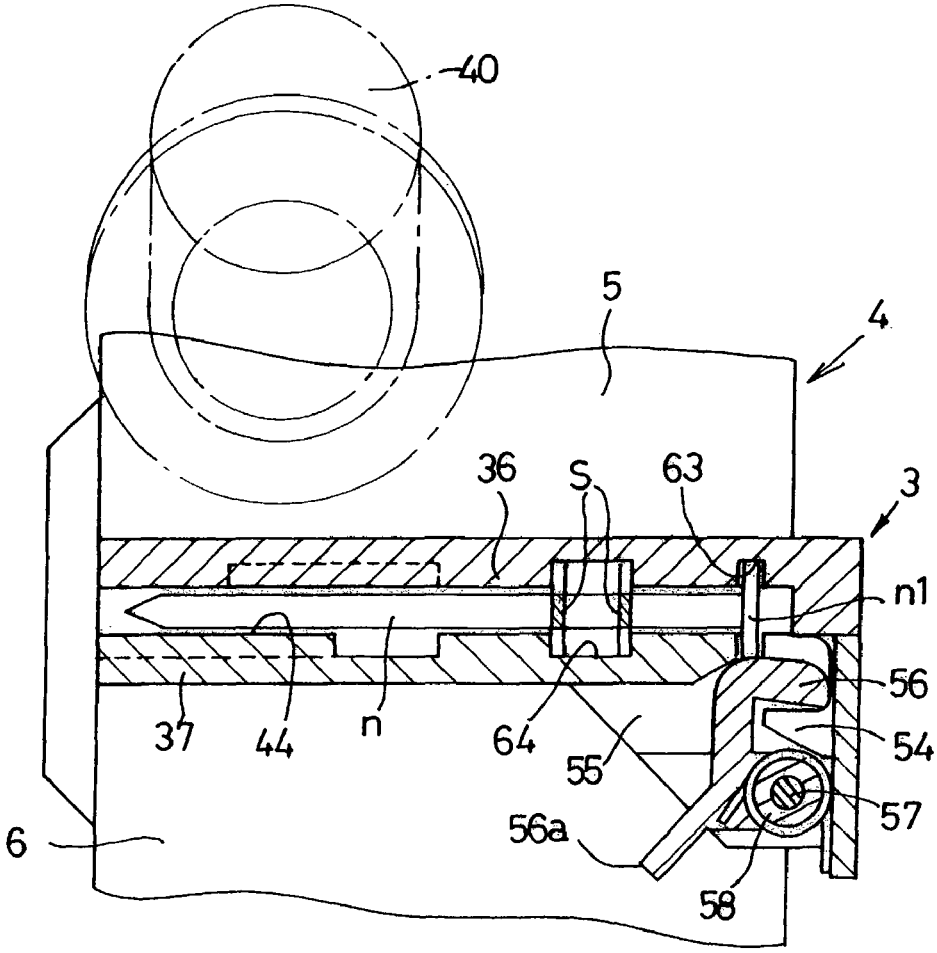
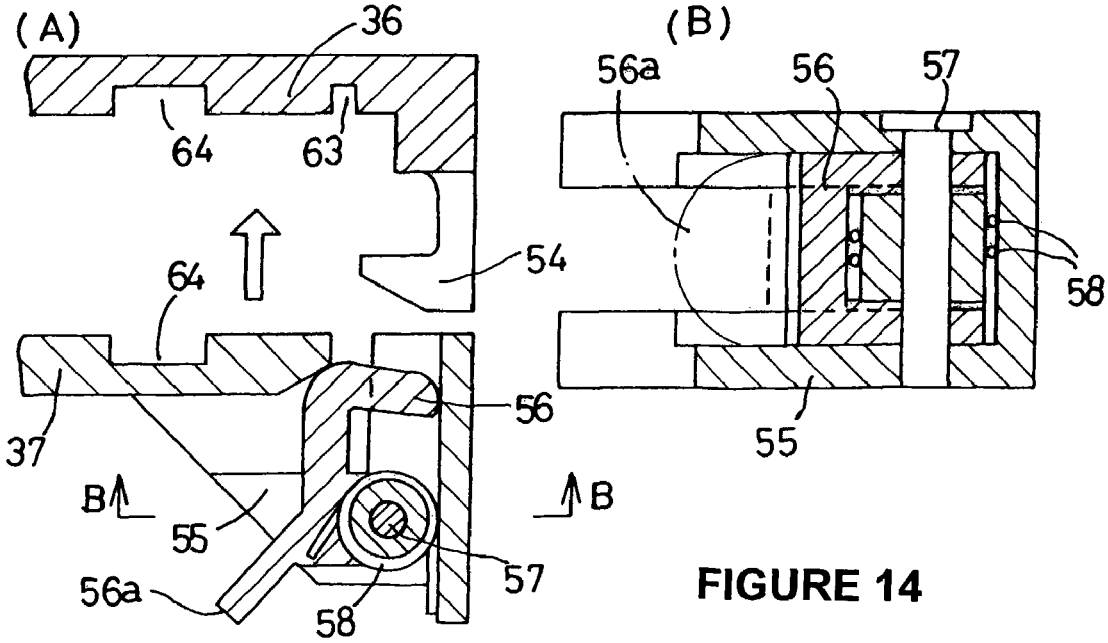
FIGURE 14

FIGURE 20
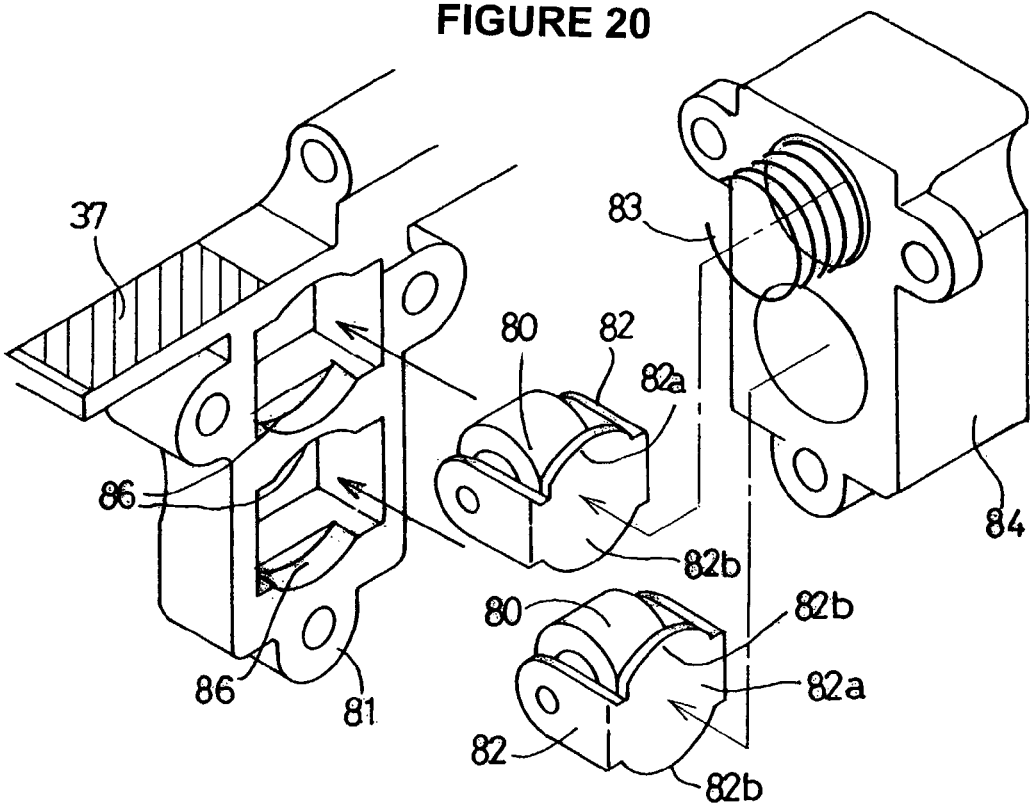
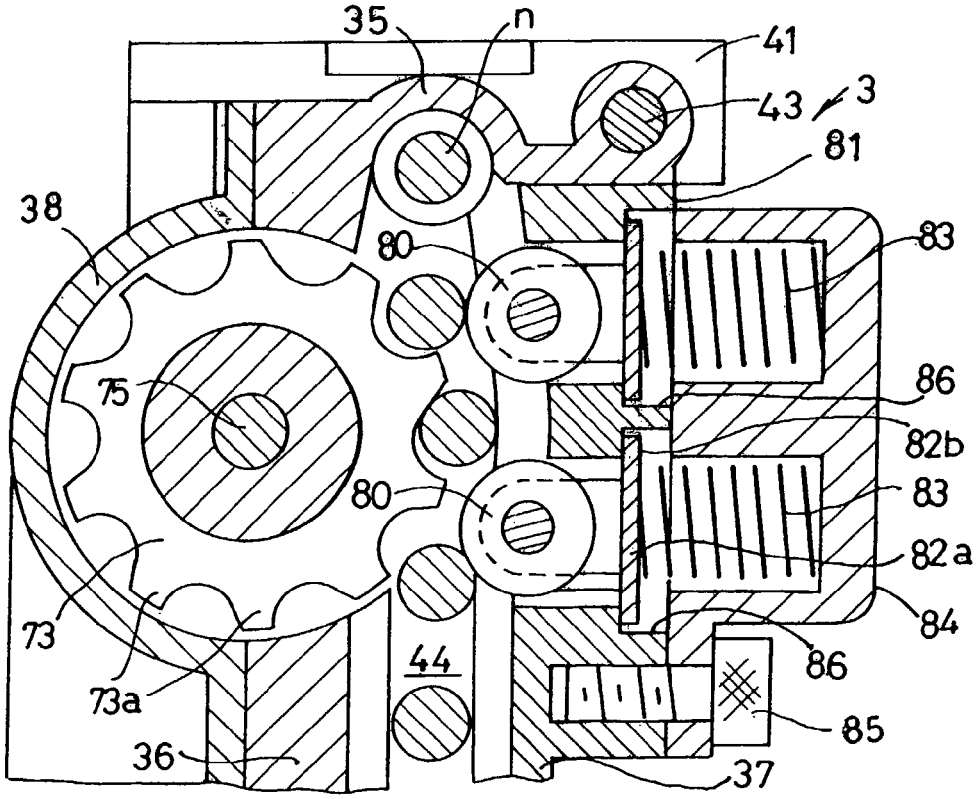
FIGURE 19

FIGURE 21
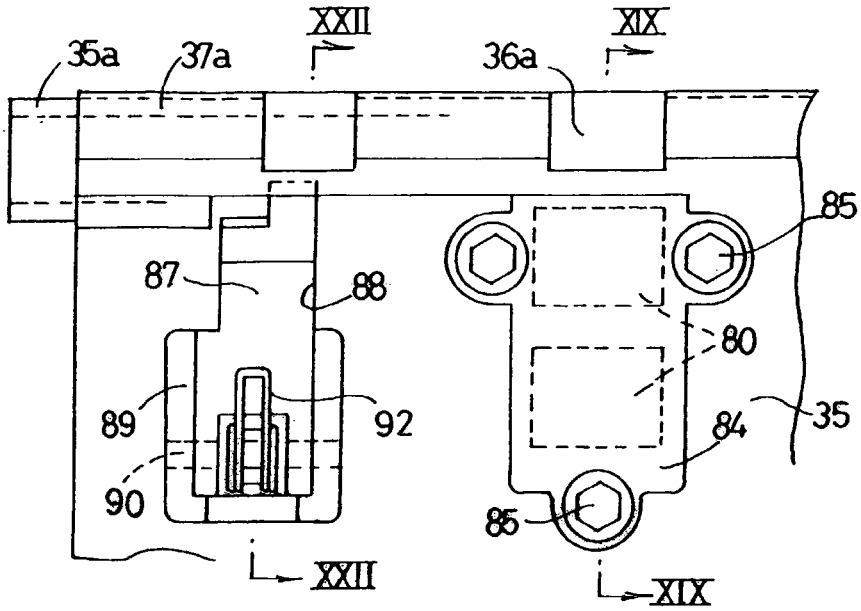
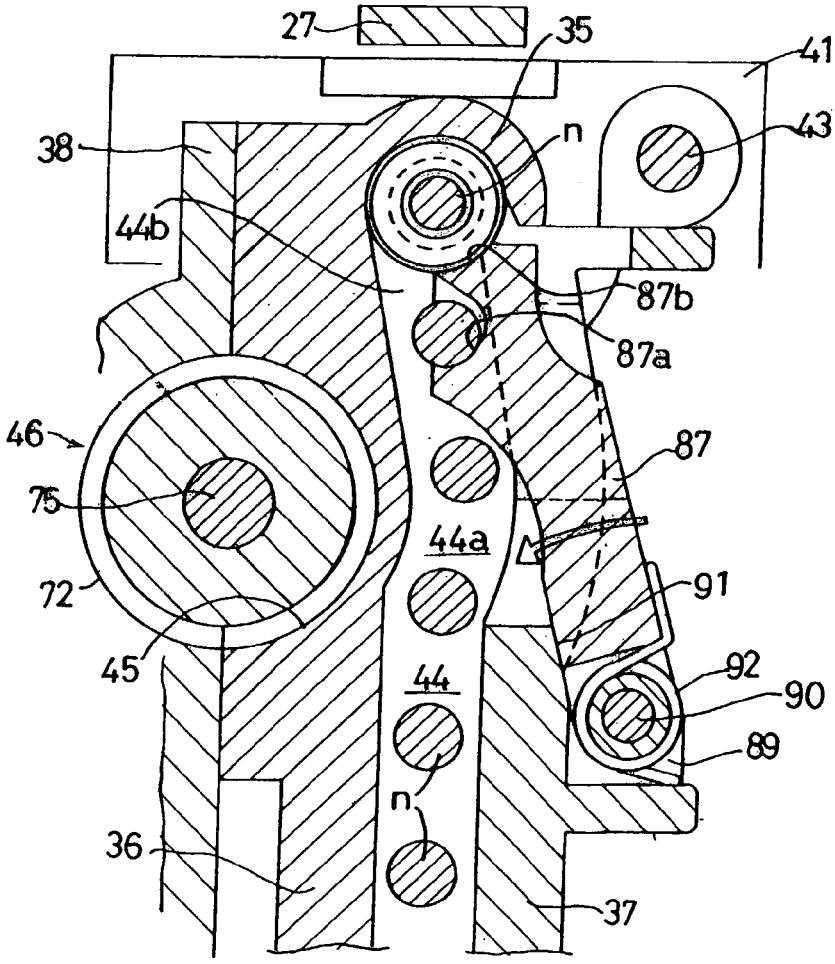
FIGURE 22

FIGURE 23
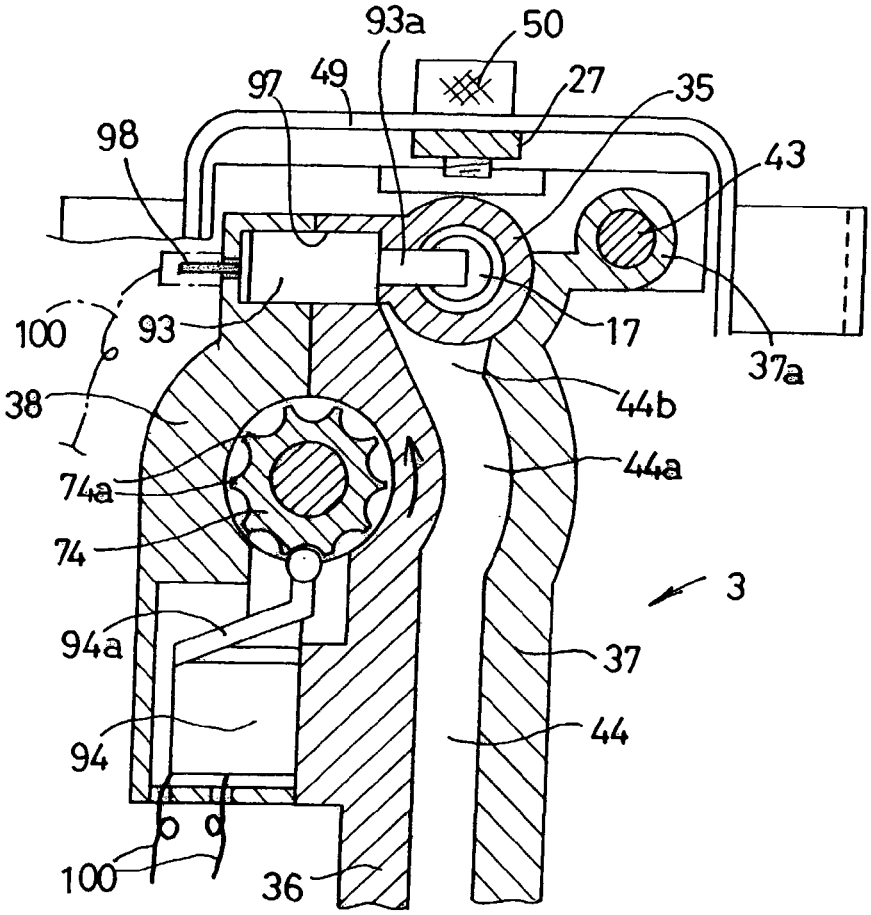
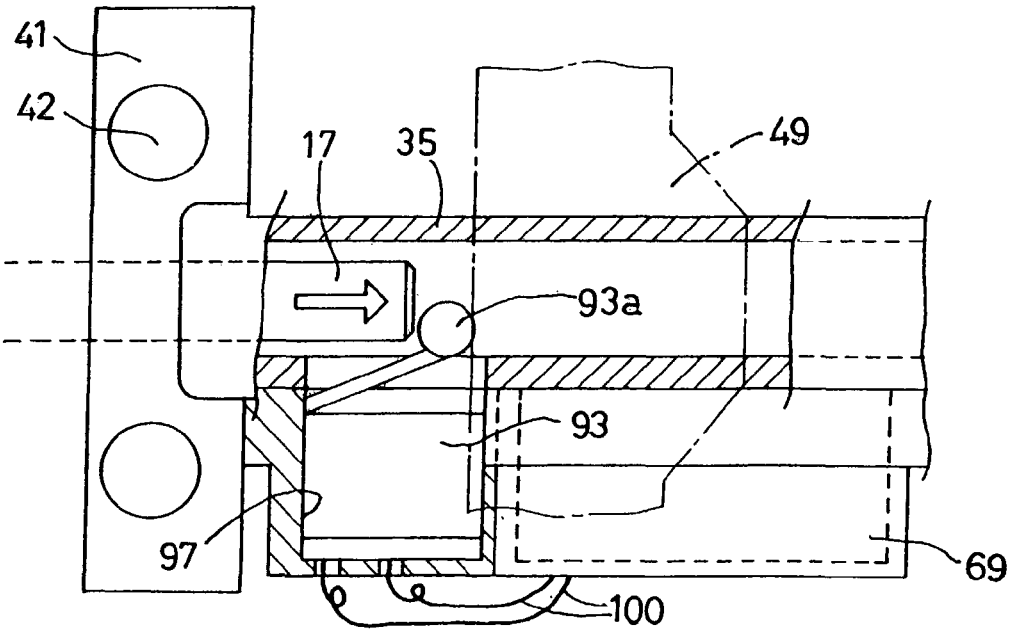
FIGURE 24

FIGURE 25
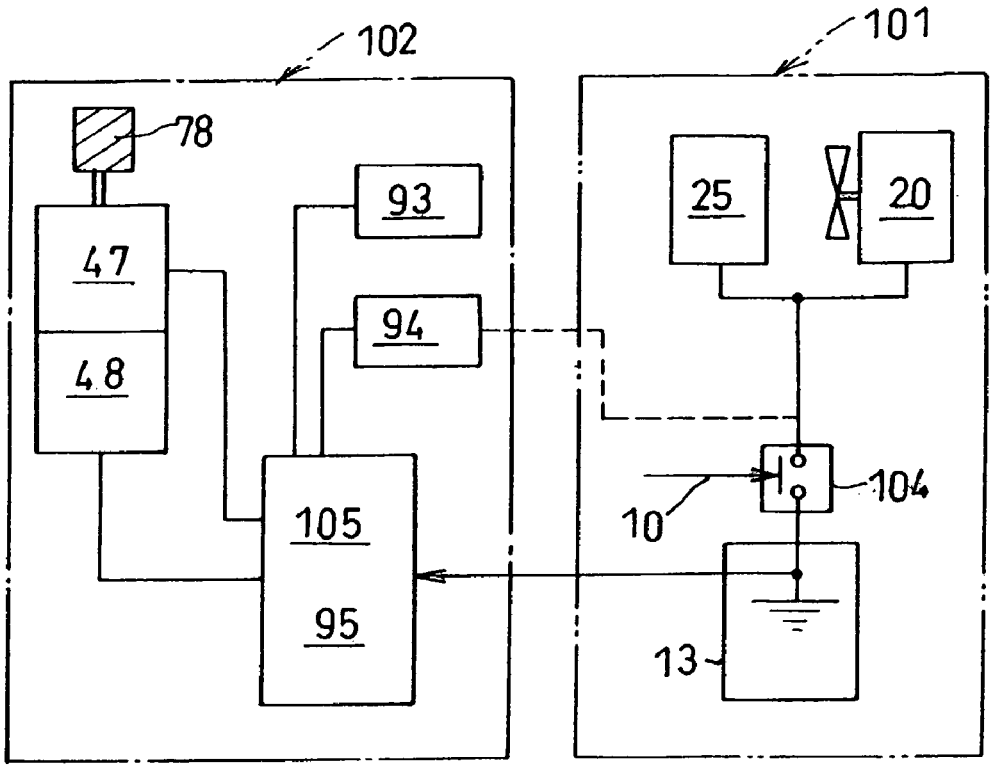
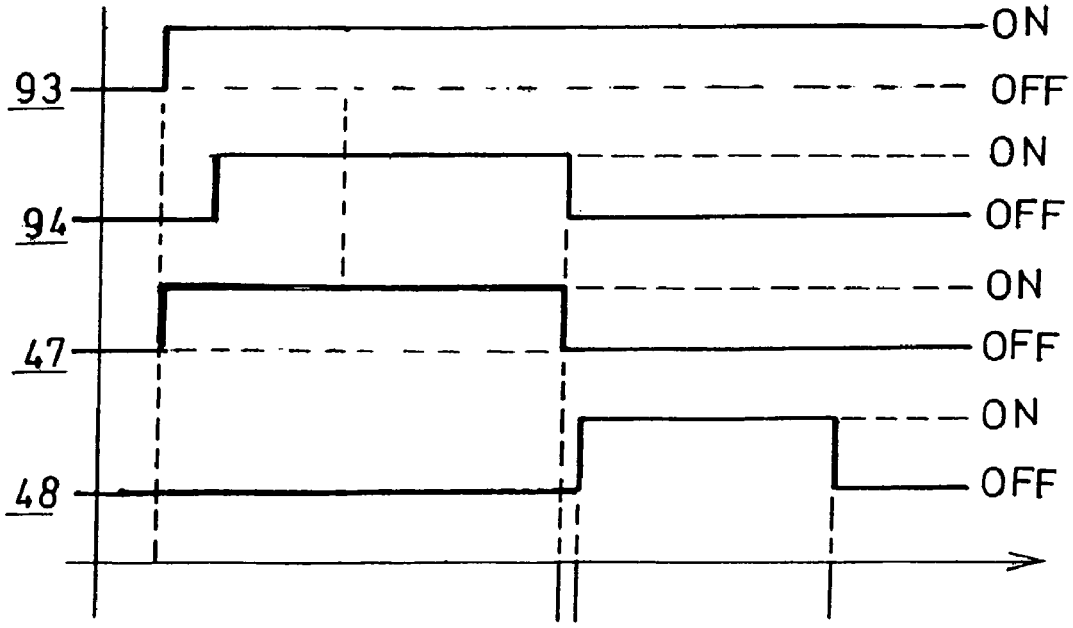
FIGURE 26

FIGURE 27
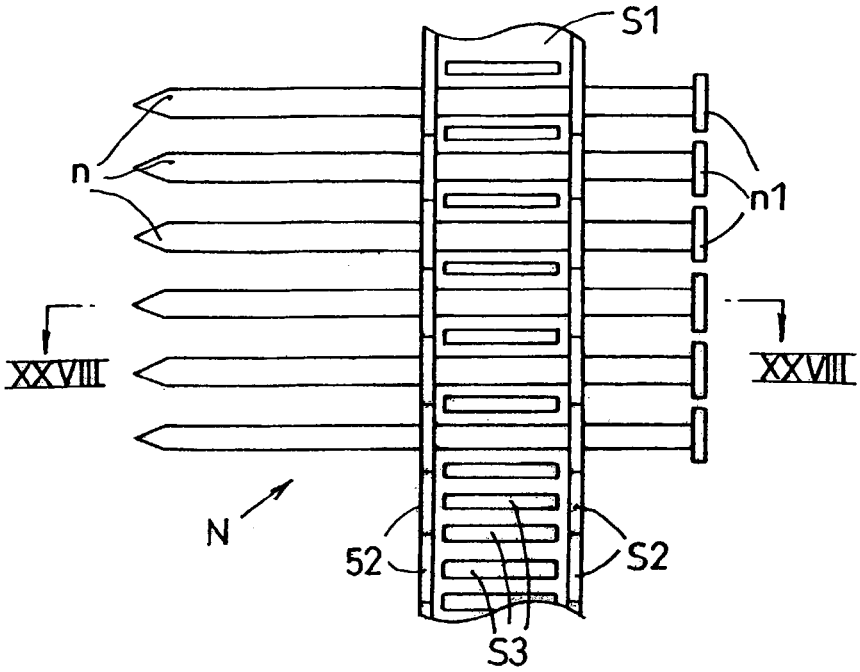
FIGURE 28
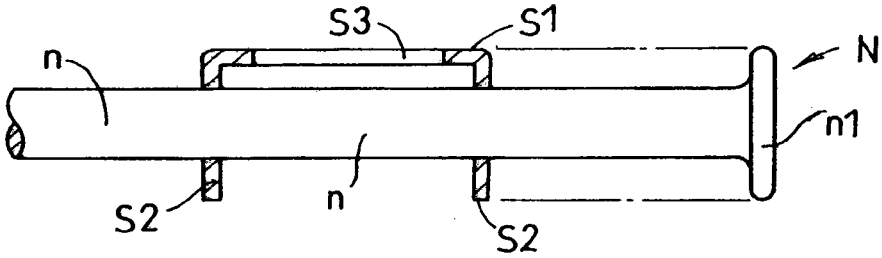
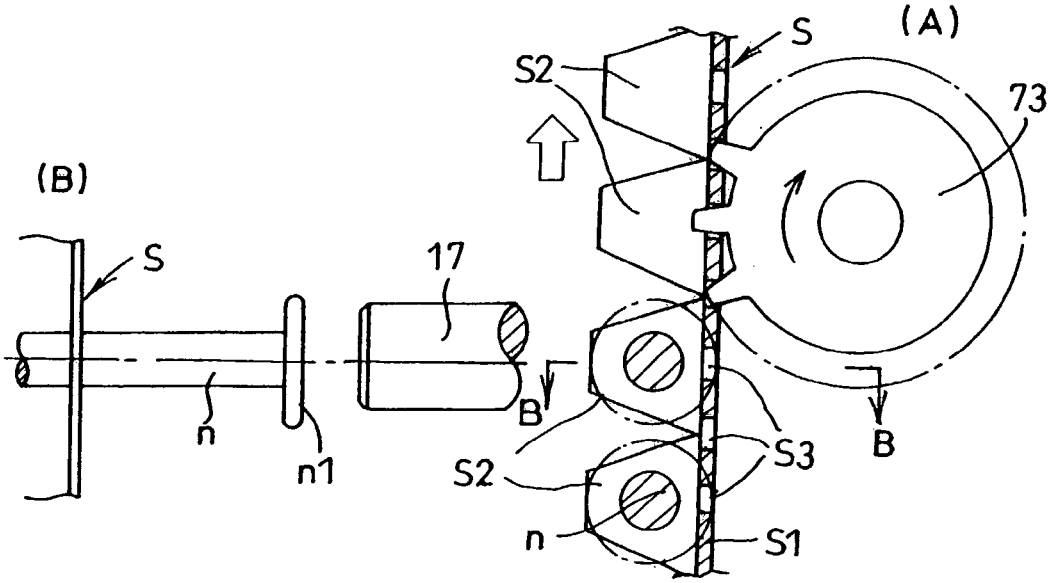
FIGURE 29

PORTABLE TYPE FASTENER DRIVING TOOL

RELATED APPLICATIONS

The present application is a National Phase entry of International Application Number PCT/IB2005/000811, filed Mar. 30, 2005, which claims priority from, Japanese Application Number 2004-105993, filed Mar. 31, 2004, the disclosure of which is hereby incorporated by reference herein in its entirety.

TECHNICAL FIELD

The present invention relates to a portable type fastener driving tool which is used to drive fasteners such as nails and pins into a workpiece by hammering them in the axial direction.

TECHNICAL BACKGROUND

Portable type fastener driving tools can be classified as nail driving devices, pin driving devices (or tack driving devices) and staple driving devices and the like on the basis of the type of fastener which is being driven. On the other hand, they can be classified as devices using compressed air, the pressure of combustion, the brisance of gunpowder and electricity and the like on the basis of the driving source.

In any case, fastener driving tools are provided with rods which are used for driving and continuous driving is permitted by supplying the fasteners one by one to the front of the rod.

Fasteners which are used with fastener driving tools are made to connecting bodies which are connected by connecting material. The fastener connecting bodies are housed in a magazine and the fasteners are supplied one by one to the front of the rod by feeding them in one pitch increments inside the magazine.

There are two main types of connecting modes for a fastener group. In one mode, multiple fasteners are connected so that they are parallel to one another by using a connecting material which is made of a material which can alter its shape such as resinous tape and narrow wire (such as metal wiring) so that this fastener connecting body can be wound to a coiled shape (or rolled or formed like a spiral). This connecting mode is often used for nails.

In another connecting mode used for a fastener group, a fastener is retained by a connecting material which extends in a straight line and which is basically rigid. As a result, in this mode, the fastener connecting body cannot be wound in a coil shape. Resin and paper are often used for this type of connecting tool.

Further, the only type of fastener connecting body in which (a) the direction in which the fasteners are arranged and (b) the shaft line of each of the fasteners are mutually perpendicular to one another is the one which can be wound in a coil. There are two types of fastener connecting bodies which cannot be wound into coils: the type where (c) the direction in which the fastener group is arranged and (d) the shaft line of each of the fasteners are perpendicular to one another; and the type where (e) the direction in which the fastener group is arranged is tilted toward (f) the shaft line of each of the fasteners. The fact that there are two types in the latter category is brought about by a difference in the position of the magazine.

Next, we shall discuss the relation between the structure of the fastener connecting body and the driving tool by providing an example of the nail and the nail driving device.

A nail connecting body which has a rectilinear shape is loaded onto a magazine so that it extends in a long straight line. The nail connecting body which has a rectilinear shape is advantageous in that it has an overall rigid body structure and does not require a special motive power and can be fed reliably by using a simple feed mechanism which uses an extension spring or a compression spring.

However, since there are limits on the length of the magazine to maintain easy handle and operation for the nail driving device users, there are limits on the length of a single nail connecting body (limits on the number of nails which can be used to make up a single nail connecting body). Therefore, in operations which involve driving a large quantity of nails in a short period of time such as when buildings are built using the 2×4 method, it is disadvantageous in that the nail connecting body must be frequently replaced.

On the other hand, nail connecting bodies which can be wound in a coil shape are advantageous in that they are loaded onto a drum shaped magazine which is schematically round when seen in cross section and a large number of nails can be accommodated efficiently inside the magazine. In other words, a single nail connecting body can be consisted of a great many nails. For this reason, it is suitable for operation for construction in which large quantities of nails are used.

Be that as it may, the nail connecting bodies which are wound into a coil shape cannot be fed just by pressing (or pulling) on a spring and a feed mechanism which has a movable feed member must be set in place near the rod.

For a nail driving tool (a "coil nailer") which uses a nail connecting body which has been wound into a coil shape, almost without exception an "air tool" which uses compressed air as the drive source is used. Specifically, a small piston used for feeding the nails is driven by compressed air, and the fastener connecting bodies are fed by using a lever which does elliptic movement links with the reciprocating motion of the piston.

However, air tools present problems in that they require an air compressor so that maneuverability is lacking on the work site. In addition, since an air hose bring resisting effect to the movement of the tool, there are problems in that a heavy burden in placed on the operator. It is unpleasant for an operator to carry out fastening operations while manipulating a hose at a work site which is cluttered with many members.

On the other hand, a "gas tool" which uses gas combustion pressure as the power source for the rod is advantageous in that it does not require special accessory devices and has outstanding maneuverability. As a result, fastening operations can be carried out anywhere and there is little physical burden placed on the operator as there is no hose. However, the prior art gas tool was inconvenient in that it could only be used with a rectilinear nail connecting body so that the nail connecting bodies had to be replaced frequently within a short period of time at a work site where many nail driving operations were being carried out.

Therefore, experiments have been carried out to use coil type nail connecting bodies on gas tools (in other words, experiments on developing a gas combustion type coil nailer). An example of this is disclosed in Patent Document 1 in which feeding of nails had been carried out using partial gas combustion pressure as a power source. Specifically, it discloses that on a gas tool (a) a nail feeding device which is equipped with a nail feeding piston like a coil type connecting nail air tool and part of the combustion gas is introduced to a cylinder in which a nail feeding piston is inserted.

[Patent Document 1] Publication of Unexamined Utility Model Application H5-72380

DISCLOSURE OF THE INVENTION

Problems which the Present Invention is Intended to Solve

The nail driving device in the aforementioned Patent Document 1 has not yet been brought to market as an actual product despite the latent demand for it.

The reasons for this are as follows: (a) combustion gas is generated instantaneously so that it is difficult to supply combustion gas in a stable fashion to a cylinder in which a nail feeding piston is inserted; (b) the nail feeding process should be carried out when the rod moves backward whereas combustion gas is generated when the rod is driven out (when it moves forward) and the timing for the generation of the combustion gas and the timing for the nail feeding do not coincide; (c) when combustion gas is used for nail feeding, the rod driving out power may decline and one is unsure as to whether the nail has been driven in assured way.

It is the main object of the invention in this application to take the current state of the art into consideration and to make it possible to use with a coil type fastener connecting body for a gas combustion type driving tool and a gunpowder type driving tool. It is another object of the invention in this application to provide a rich diversity of structures which may be used for the fastener driving tool and to provide reliable nail feeding operations.

Means Used to Solve the Problems

When prior art fastener driving tools were being developed, there was no conception of feeding fastener connecting bodies by a motive power which was different from the rod drive source. Thus, it could be said that people were at a dead end when they considered the technology in Patent Document 1. On the other hand, the inventors have modified the prior art concept and have carried out repeated tests and experiments and have been able to achieve the invention in this application.

This means that the invention indicated in Claim 1 is a nail driving tool which is provided with (a) a main body which houses a rod which drives in the fasteners; (b) a rod driving out means which pushes the rod forward in the axial direction; (c) a head part which is disposed on the front end of the main body and which is provided with a fastener guiding part; (d) a fastener retaining means which loads a fastener connecting body which is made by connecting multiple fasteners using a connecting material so that they are arranged parallel to one another; and (e) a power operated fastener feed means which feeds the fastener connecting bodies which is loaded on the aforementioned fastener retaining means, in the direction in which the fasteners are arranged and which feeds the fasteners one by one in front of the rods; the invention being characterized as having a drive source for the aforementioned fastener feed means which is different from the drive source of the rod driving out means.

In the invention in Claim 2, the aforementioned rod driving out means disposes the aforementioned rod on a piston which is moved forward by the pressure of the combustion gas. As a result, the rod driving out means is provided with (a) a gas combustion chamber; (b) an electric spark type ignition plug which ignites in the gas inside the combustion chamber; and (c) a battery which provides an electric power supply to the aforementioned ignition plug. Meanwhile the aforementioned fastener feed means is provided with an electrically driven actuator such as a motor or an electromagnetic solenoid. Power supply to the aforementioned electrically driven actuator is carried out from the battery for the aforementioned rod driving out means or else a separate feed battery is set in place exclusively for the electrically driven actuator.

In the invention in Claim 3, the aforementioned fasteners are nails and a fastener connecting body which is permitted to be wound in either a coil shape or a roll shape. Meanwhile the aforementioned fastener retaining means is a magazine which is provided with a cover which can be opened and closed at will. This magazine is formed like a drum which is schematically round when seen in cross section so that it can house the nail connecting bodies when it is wound either in a coil shape or a roll shape.

The invention in Claim 4 is provided with (a) an electric motor which is used to feed the fastener connecting bodies; (b) a first sensor which is used to detect the movement of the rods; (c) a second sensor which is used to detect the fasteners which are fed either directly or indirectly; and (d) a braking means which is used to stop the motor from turning. It is set so that when the first sensor detects that the rod has moved backwards, the motor is driven and it starts feeding the fasteners. When the second sensor detects that the feeding of the fasteners is complete, inertial rotation of the motor is prevented by the aforementioned braking means.

EFFECT OF THE INVENTION

According to the process of the invention in this application, the fastener feeding is carried out independently of from the driving of the rod so that the fasteners can be fed precisely without adversely affecting the reliability and the accuracy of the fastener driving carried out by the rod.

One specific mode of the present invention involves feeding the fasteners using an electrical actuator in the gas combustion type driving tool (gas tool) as described in Claim 2. This makes it possible for the fastener connecting body to be fed accurately and reliably even if it is the coil type described in Claim 3. As a result, the gas combustion type driving tool which has outstanding maneuverability has been successfully placed on the market as a coil nailer.

The inventors carried out experiments to see how much electric power is required to feed the nail connecting body which is usually used by using a motor. As a result, it was determined that the nail connecting bodies can be fed using a small amount of electric power.

On the other hand, the gas combustion type driving tool has as an indispensable member an ignition plug which ignites gas and a motor-rotated fan as an optional member. Power is fed from a battery to the ignition plug and the fan. This means that the gas type driving tool is provided with a battery which supplies electricity at least to the ignition plug (there are also two types of battery: the charging type and the replacement type).

The inventors took note of this point and carried out experiments on power supply to the fastener feed motor from the charging type battery used for the ignition plug and the fan. When they used a charging type battery, they carried out driving operations continuously at the same driving frequency as when they used the conventional gas driving tool by charging it once. As a result, when they carried out fastener feeding using a battery which was originally provided with a gas driving tool, they were able to simplify the structure.

Needless to say, an exclusive fastener feed battery may also be set in place. When the head and the magazine are made into a unit and made them exchangeable to be used with the existing gas tool, it is most likely preferable to set in place an exclusive battery for the unit out of consideration of the ease of the wiring operations. In addition, when power supply is carried out using a cord (cable) from an outside power source for the gas driving tool such as that disclosed in [Japanese] Unexamined Patent Application H8-290370, the electrical actuator should be driven using this outside power source.

The example of development of the invention in this application is not necessarily restricted to a combination of rod driving using a gas driving tool and fastener feeding using an electrical actuator. In another example of development of the invention the fasteners are fed by setting in place an electrical actuator in a gun using powder which drives the rod when the gunpowder explodes. The fasteners in the air tool can be fed by using the electrical actuator. In this case, it is advantageous in that the degree of freedom of the feed mechanism can be upgraded and it can contribute to make diversity greater in fastener driving tools.

In addition, when the prior art gas driving tools were used, the fasteners were fed using a spring so that the fastener connecting body had an overall solid structure. However, there were the following problems. When the fastener connecting body had a solid structure, the residue from the connecting material would scatter thus making for a poor work environment. In addition, the residue from the connecting (tool) would be left on the surface being worked on leading to a deterioration in the appearance of the surface.

On the other hand, in one development of the invention in this application, a rectilinear type fastener connecting body, not coil type, could be fed using a gear type (sprocket type) feed means as disclosed in the first practical embodiment of the invention. Thus, the fastener connecting bodies could be fed accurately even if the overall structure was not a rigid body. As a result, it was possible to connect the fastener groups using a soft thin film-like connecting material so that the problems arising from the residue of the connecting material could either be eliminated or ameliorated.

Be that as it may, when the fastener driving tool is used, the fasteners must be supplied to the front of the rod after the rod has completely gone backwards. Feeding the fasteners before the rod went back or while it was going forward would lead to an accident or a malfunction.

On the other hand, when a gas combustion driving tool is used, the pulling movement of the trigger is detected by an electrical switch, the ignition plug is energized when this trigger switch is turned on and combustion (an explosion) occurs. (However, it should be noted that if the safety device is not operated, the ignition plug will not be energized even if the trigger switch is turned on).

Therefore, when fasteners are fed using an electrical actuator, using the signals from the trigger switch is one way of detecting the rod when it moves backward. This means that the time from when the trigger switch is turned on and the rod moves forward and the regression is complete can be found out beforehand. As a result, this is thought to be a control method in which the backward movement of the rod is detected and then the electrical actuator is operated to feed the fasteners.

However, there are problems when this method is used in that when the rods stops due to some type of trouble while it is going backwards, the fasteners can no longer be fed and the electrical actuator may be damaged (burnout). In addition, in the prior art, the rods could move forward even if the fasteners were not supplied to the front of the rod so that it was impossible to prevent "mis-shot" wherein only the rod went forward.

On the other hand, when the configuration indicated in Claim 4 is used, the backward movement of the rods can be reliably detected so that feeding errors can be prevented. At the same time, "mis-shot" wherein only the rod moves forward can be prevented and the motor can be prevented from rotating excessively which makes it particularly suitable. Further, the first sensor and the second sensor may be a contact type sensor and/or a non-contact-type sensor, however, the contact type sensor is preferable since it is able to prevent malfunctions.

OPTIMAL MODE OF CARRYING OUT THE PRESENT INVENTION

Next, we shall describe a mode in which the invention in this application is applied to the nail driving device based on figures. FIG. 1 through FIG. 26 are the first practical embodiment (main embodiment) of the present invention.

BRIEF EXPLANATION OF FIGURES

FIG. 1 (B) a partial inclined view of the nail connecting body.

FIG. 7 FIG. 7(A) . . . a partial exploded inclined view of the head part; FIG. 7 (B) a sectional view of (A) seen along B-B.

FIG. 13 A sectional view of FIG. 5 and FIG. 7 (A) seen along XIII-XIII.

FIG. 14 FIG. 14 (A) a diagram showing the subguide body when it is slightly open from the position indicated in FIG. 13. FIG. 14 (B) is a sectional view of FIG. 14 (A) seen along B-B.

FIG. 19 A sectional view of FIG. 5 and FIG. 21 seen along XIX-XIX.

FIG. 20 An exploded inclined view which explains the state in FIG. 19.

FIG. 21 A right lateral view of the upper part of the head part.

FIG. 22 A sectional view of FIG. 21 seen along XXII-XXII.

FIG. 23 A sectional view of FIG. 12 and FIG. 13 seen along XXIII-XXIII.

FIG. 24 A sectional view of FIG. 12 and FIG. 13 seen along XXIV-XXIV.

FIG. 25 A block diagram indicating the relationships in the electrical system.

FIG. 26 An explanatory control diagram indicating the relationship between the motor, the brake and the sensors.

FIG. 27 A partial lateral view of the nail connecting body in the second mode of carrying out the present invention.

FIG. 28 A sectional view of FIG. 27 seen along XXVIII-XXVIII.

FIG. 29 FIG. 29 (A) a schematic view showing the nail connecting bodies when they are fed. FIG. 29 (B) a diagram of FIG. 29 (A) seen along B-B.

(1) OVERVIEW

Figure 1:
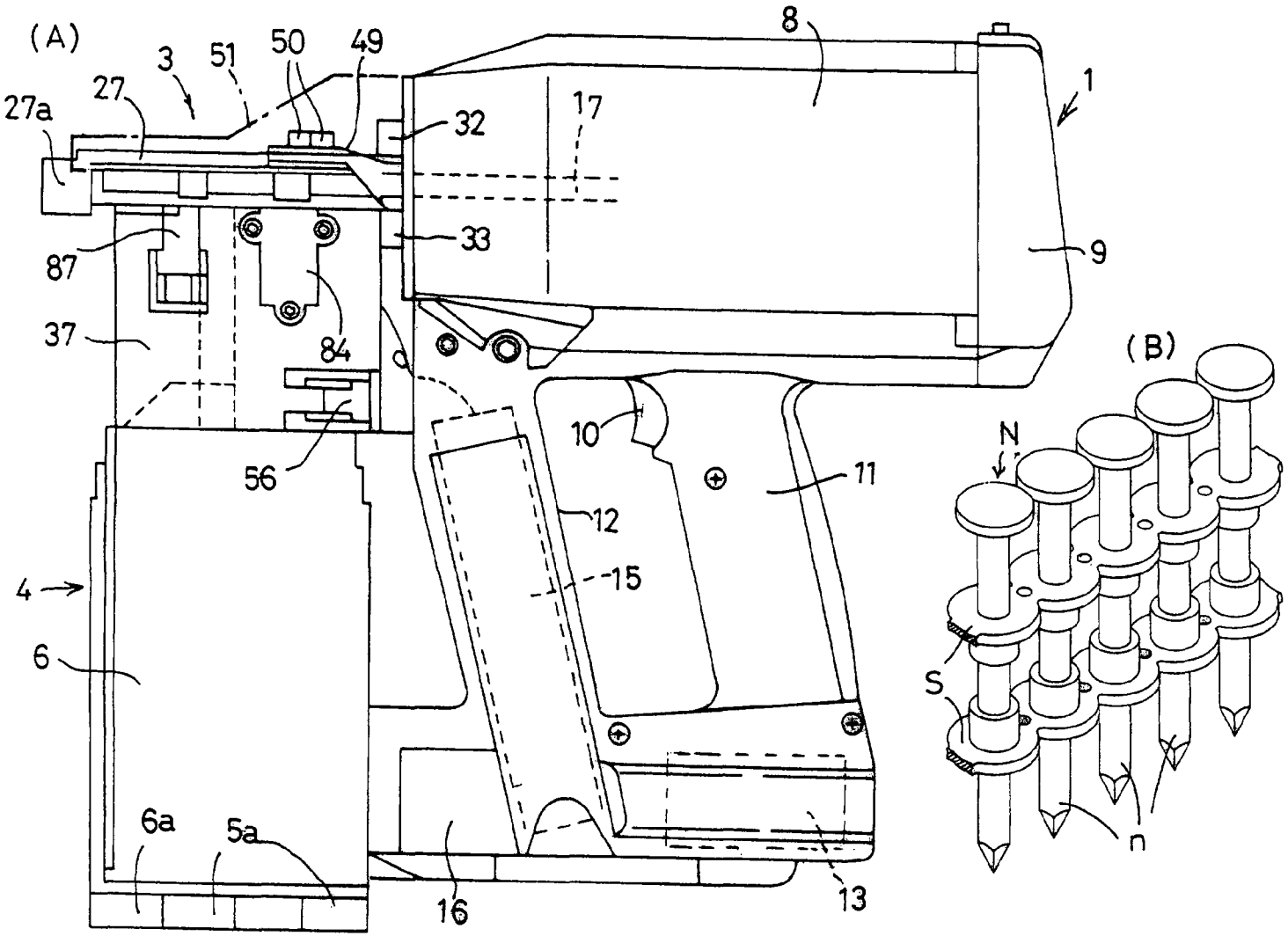
FIG. 1 FIG. 1 (A) Right lateral view of gas combustion type nail driving device.
Figure 2:
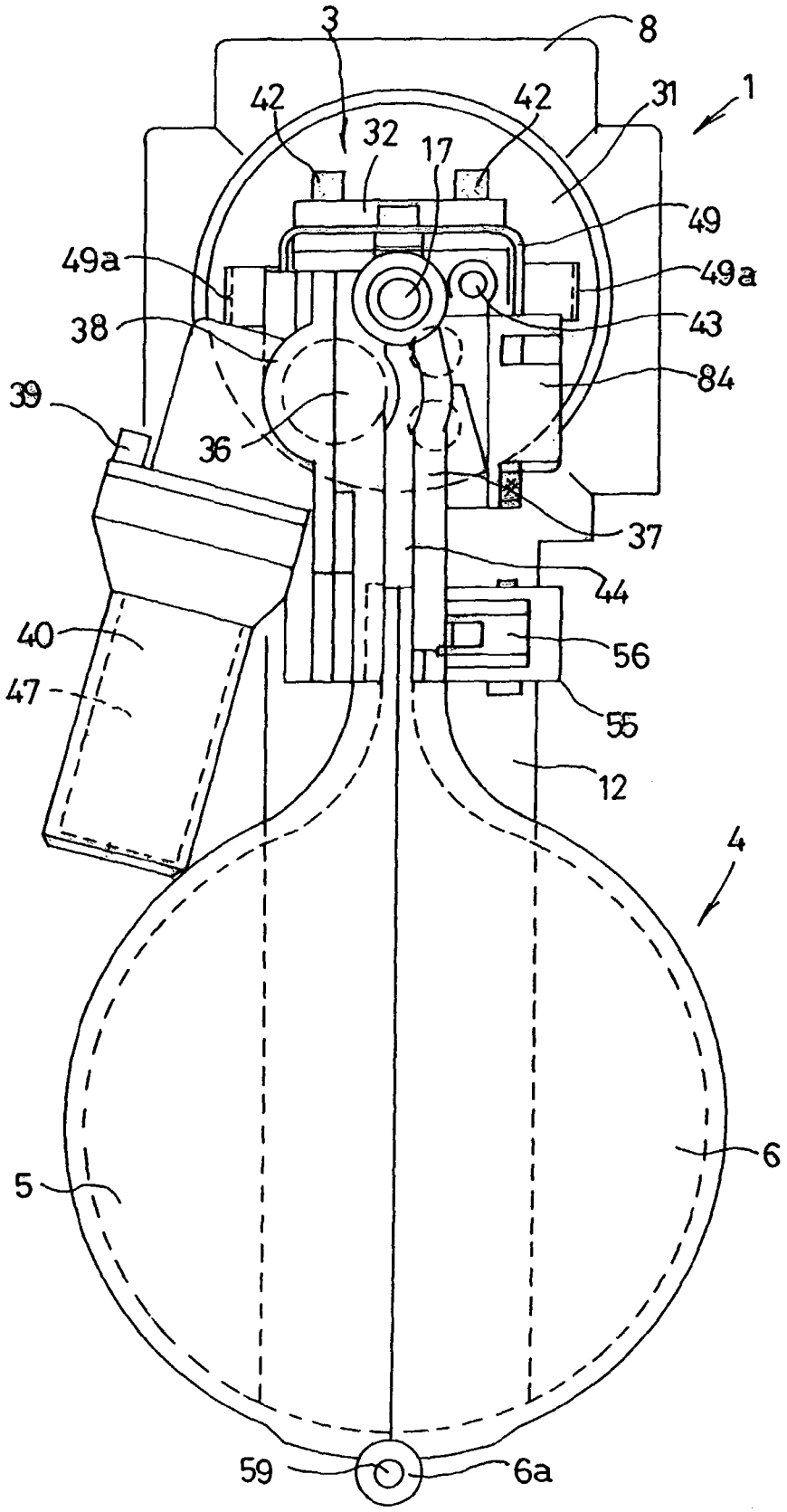
FIG. 2 Frontal view of the nail driving device.
Figure 3:
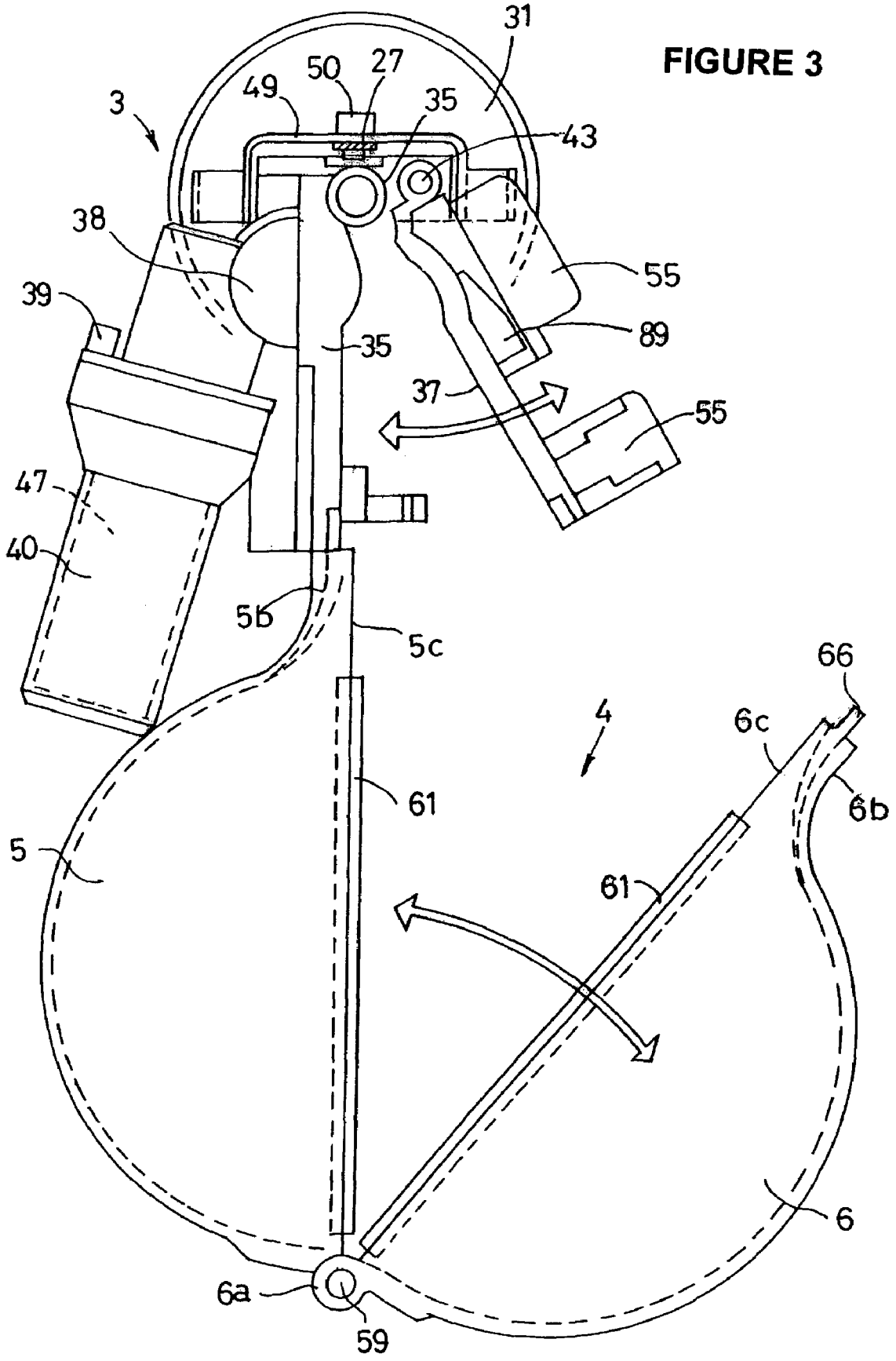
FIG. 3 Frontal view showing the magazine when it is open.
Figure 4:
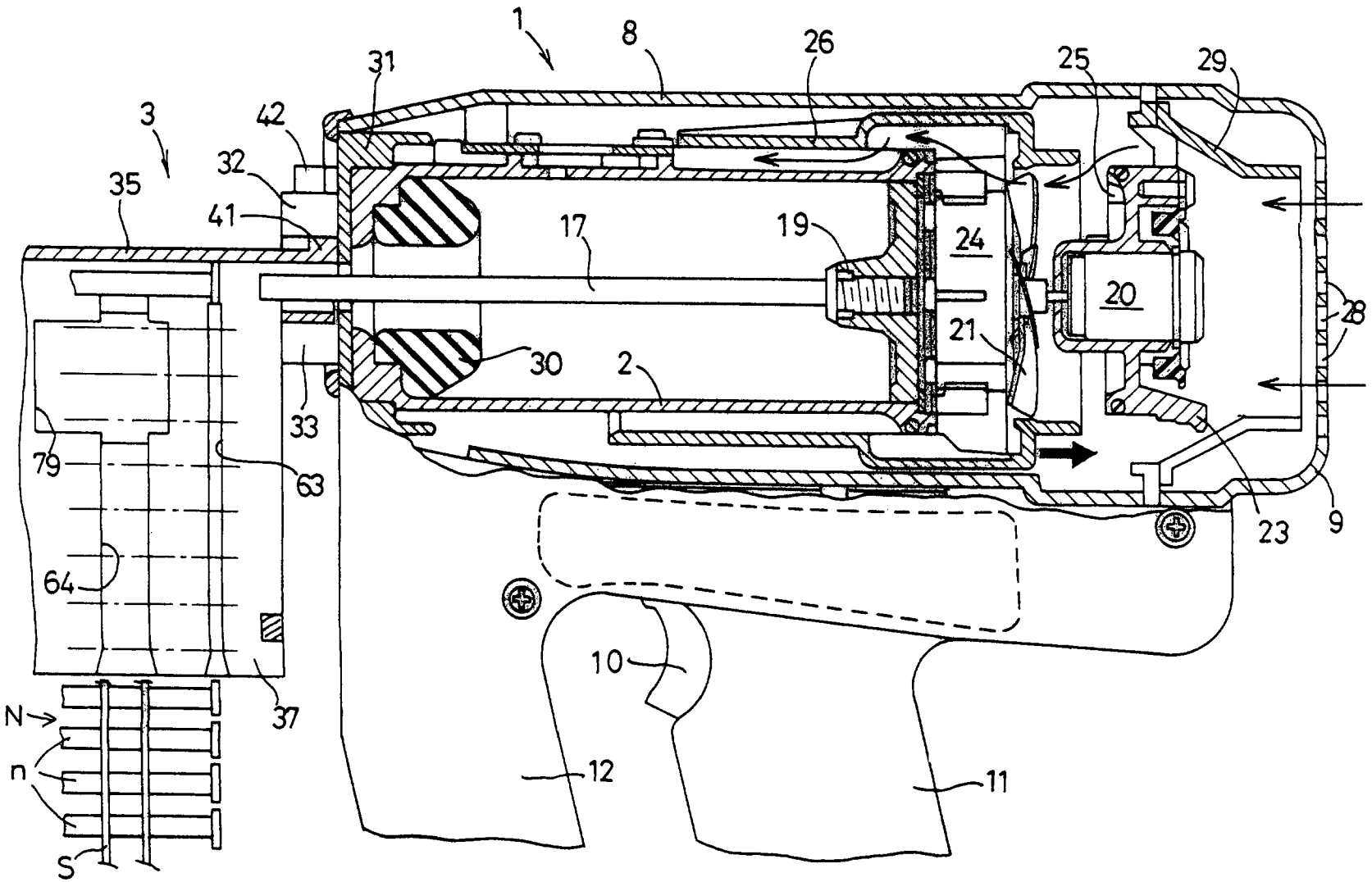
FIG. 4 Vertical lateral view of the nail driving device.
Figure 5:
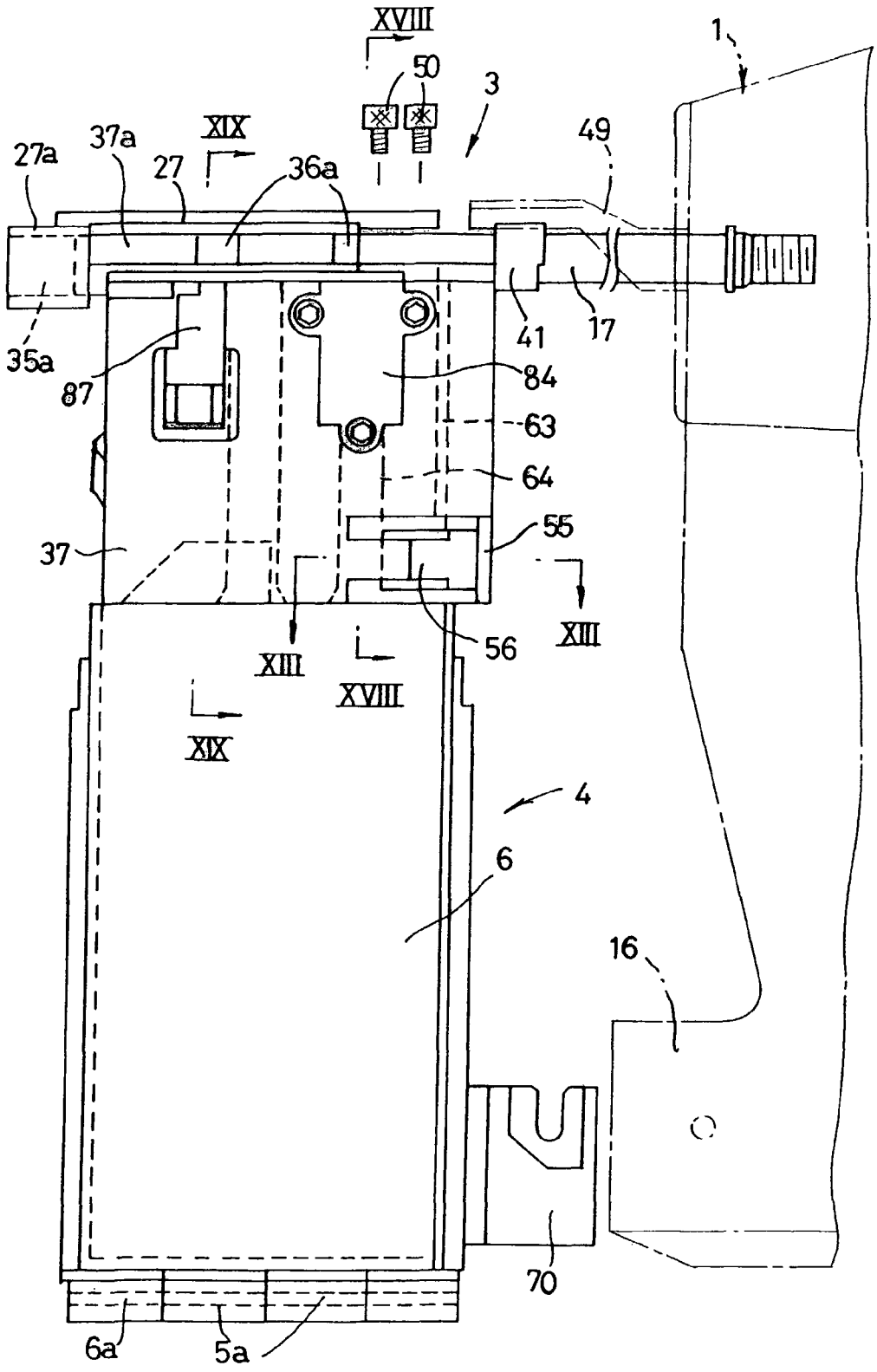
FIG. 5 Right lateral view of the head part.

First, we shall provide an overview based on FIG. 1 through FIG. 4 and explain the basic operating structure. FIG. 1 (A) is a right lateral view of the gas combustion type nail driving device (coil nailer); FIG. 1 (B) is a partial inclined view of the nail combined body N which is used in the nail driving device. FIG. 2 is a frontal view of the nail driving device when it is in drive enabled mode. FIG. 3 is a frontal view showing the nail driving device when the magazine is open. FIG. 4 is a vertical lateral view of the nail driving device. FIG. 5 is a right lateral view of the head part.

As can be seen from FIG. 1 and FIG. 4, the nail driving device is provided with (a) a main body (body) which houses a cylinder 2; (b) a head part 3 which is disposed on the front surface of the main body 1; and (c) a magazine 4 which is attached to the head part 3 so that it can be attached and detached.

As indicated in FIG. 1 (B), the nail connecting body N is shaped so that it connects multiple nails n which are arranged on two resinous connecting bodies (strips) and this nail connecting body N is housed in the magazine 4 by winding in a coil shape (further, in the explanation given from this point forward, when it is not necessary to distinguish between a single body nail and a connecting body, the term "nail n" is sometimes used).

As indicated in FIG. 3, the magazine 4 is made up of (a) a fixed member 5 which is attached to the head part 3; and (b) a movable member (cover) 6 which is connected to the bottom end of this fixed member 5 by a pin 59 so that it can open and close at will.

The main body 1 is provided with (a) a main housing 8 which is hollow and which configures the shape of the main body 1; and (b) a rear cover 9 which is anchored to the rear surface of the main housing 8 by screws. (c) A grip (handle) 11 which is hollow and which is provided with a trigger 10 on the top end and (d) a front part 12 which is positioned so that it slants forward when seen from the side and positioned at the front of the grip are disposed on the bottom surface part of the main housing 8 so that they extend downward.

A fuel cell chamber with an opening which faces downward and which is closed by a cap is located on the front part 12. A gas cartridge (gas cylinder) 15 is housed in this fuel cell chamber. The gas cartridge 15 can be inserted and removed by opening and closing the cap. There is an open space on the bottom of the grip 11 and a charging-type battery 13 is housed in this open space.

Further, the grip 11 is hollow and a circuit unit (not shown in figure) which controls the driving operations is disposed inside this. The front part 12 and the lower end of the grip 11 are connected so that they form an integral piece. A support bracket part 16 which retains the magazine so that it does not fall is disposed on the front of the bottom end of the front part 12 so that it protrudes.

As can be seen from FIG. 4, the nail connecting bodies N which are housed in the magazine 4 are fed to the head part 3 in one pitch increments and the nail n is moved forward by the impact of the rod 17 and is driven into the workpiece.

(2) BASIC STRUCTURE OF OPERATIONS

Next, we shall provide a simple explanation of the basic structure of the nail driving device operation based on FIG. 4. A piston 19 is inserted inside the cylinder 2 so that it can slide at will. A rod 17 (a driver blade or a hammer blade) is attached to this piston 19. In this mode of carrying out the present invention, the rod 17 is attached to the piston 19 by a screw-in. The rod 17 can also be made so that it forms an integral structure with the piston 19.

Further, when a structure and indicated direction are specified in the Specification by wording such as "up and down", "left and right" and "front and backward", "left and right" is based on the direction facing the user (the direction in which the rod moves forward and the direction opposite that). "Front and backward" is based on the direction in which the rod 17 either moves forward or backward. "Up and down" is based on the state wherein the user maintains the nail driving device at a position where the rod 17 is horizontal. As a result, the head part 3 is disposed at the front of the main body 1 and the magazine 4 is disposed at the bottom of the head part 3.

The fan 21 which is driven by the fan motor 20 is disposed at the rear of the cylinder 2. The fan motor 20 is fixed to the cylinder head 23. The space between the rear end of the cylinder 2 and the cylinder head 23 is combustion chamber 24.

As a result, the fan 21 is disposed inside the combustion chamber 24. The fan 21 is main part used for stirring together the combustion gas and the air, for scavenging the combustion gas and for cooling the member which encompasses the combustion chamber 24. An ignition plug 25 which faces the combustion chamber is disposed on the cylinder head 24. Further, the cylinder 2 may be made into the combustion chamber 24.

The schematic rear half of the cylinder 2 is hollow and is surrounded by the valve sleeve 26 which can move back and forth in the axial direction of the rod 17. The valve sleeve 26 forms a part of the safety device so that the rear part has the larger outer diameter. Then, when the nose member 27 (to be discussed in detail later on) makes contact with the workpiece, the valve sleeve 26 moves backward whereupon the rear part of the valve sleeve 26 fits together perfectly with the cylinder head 23. At the same time, the front part of the valve sleeve 26 of smaller diameter fits together perfectly with the periphery of the cylinder 2. Accordingly, the combustion chamber 24 is sealed and at the same time that it became the lock-released condition in that if the trigger 10 is pulled the ignition plug 25 could be energized.

The combustion gas which fills the gas cartridge 15 is supplied to the combustion chamber via a dosing nozzle (not shown in figure) and a control valve. An intake opening 28 is also located on the rear cover 9 in order to mix the air with the combustion gas. The rear part fan 22 and the rear part of the cylinder head 23 are surrounded by the guide member 29 so that the air can flow suitably into the combustion chamber 24. An interval is also located between the guide member 29 and the sleeve 26. An aperture which opens to the front is located between the main housing 8 and the cylinder 2.

When the valve sleeve 26 goes backward and the trigger 10 is pulled, the fan 21 turns and the fuel gas and the air are stirred together in the combustion chamber 24 and at the same time the ignition plug 25 is energized, the mixed gas is ignited and the gas burns (explodes). This makes it possible for the piston 19 and the rod 17 to move forward and the nail to be driven out. A buffer member 30 which is used to absorb the shock of the piston 19 is disposed on the front end part of the cylinder 2.

An auxiliary front surface member 31 which makes up the front surface of the main body 1 is anchored to the front end surface (front end) of the cylinder 2 by screws (not shown in figure). A protruding part 32 which is disposed on the top and on the bottom of the rod 17 is formed on the front surface member 31 and fixes the head part 3 onto this protruding part 32 (the head part 3 may be fixed directly to the front surface of the cylinder 2 or to the front surface of the main housing 8). Next, we shall describe the head part 3 and the magazine 4 by referring to FIG. 6 and following figures.

(3). OVERVIEW OF HEAD PART AND MAGAZINE

Figure 6:
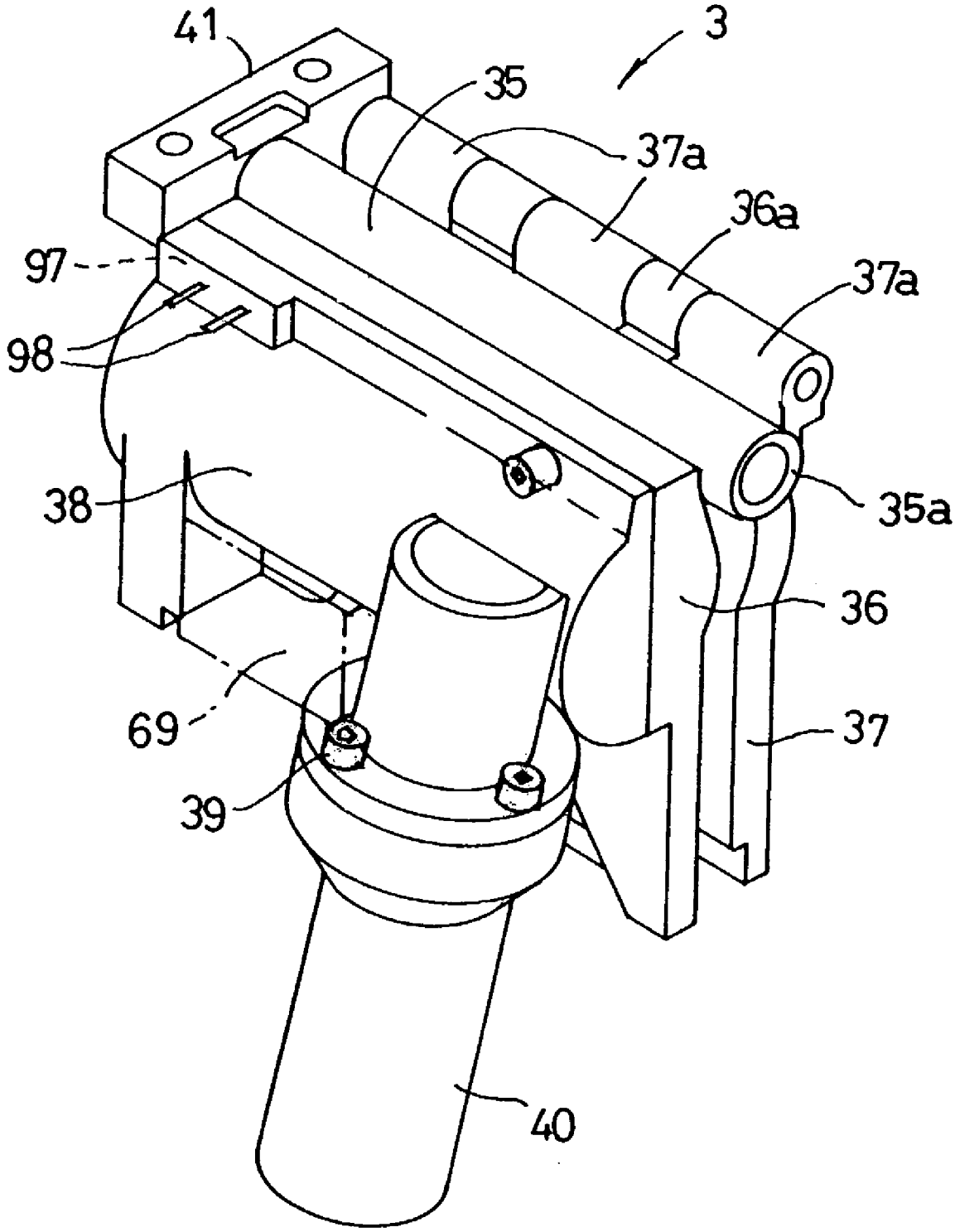
FIG. 6 Inclined view of head part when seen from the front and left, at an incline.
Figure 7:
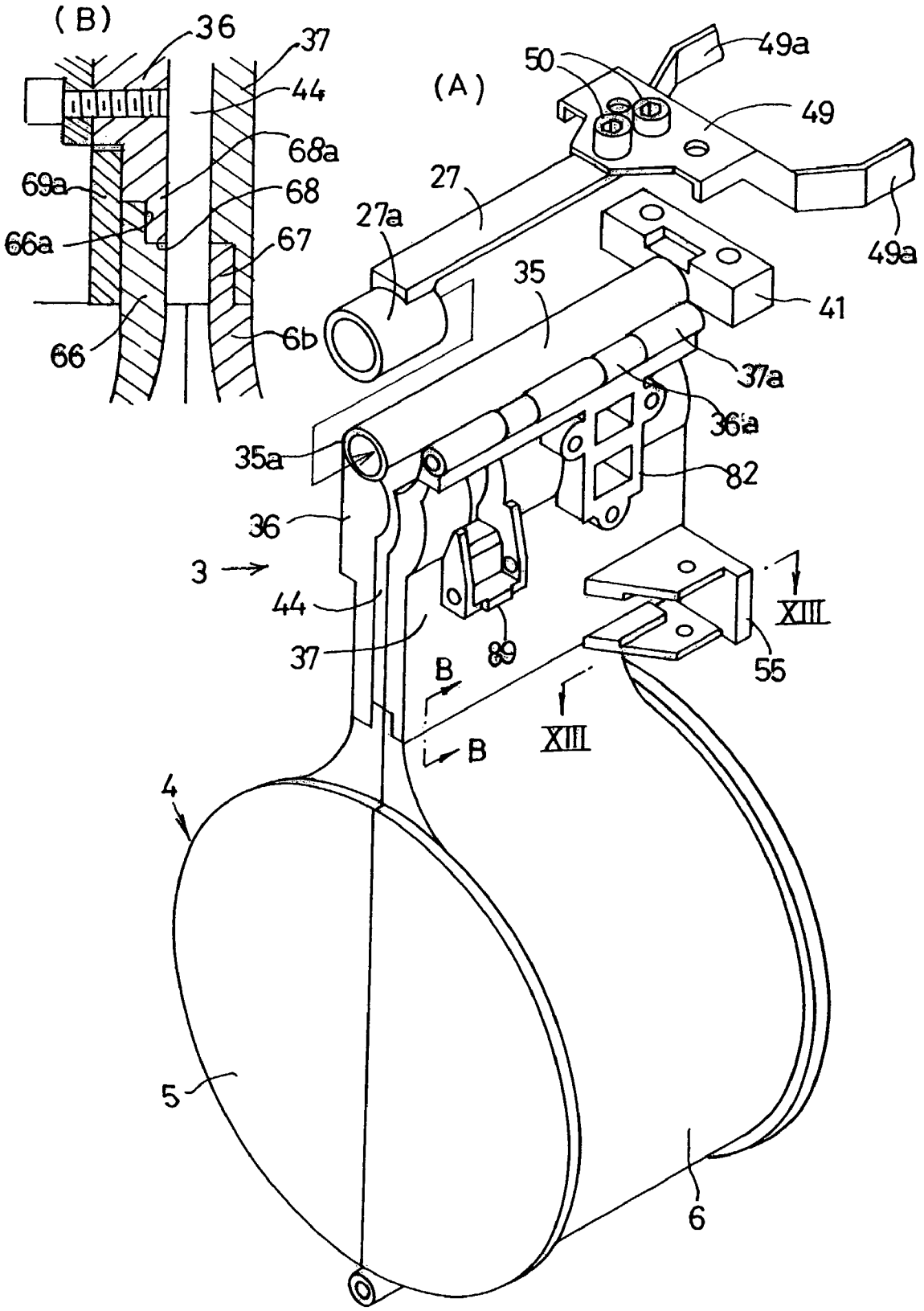
Figure 8:
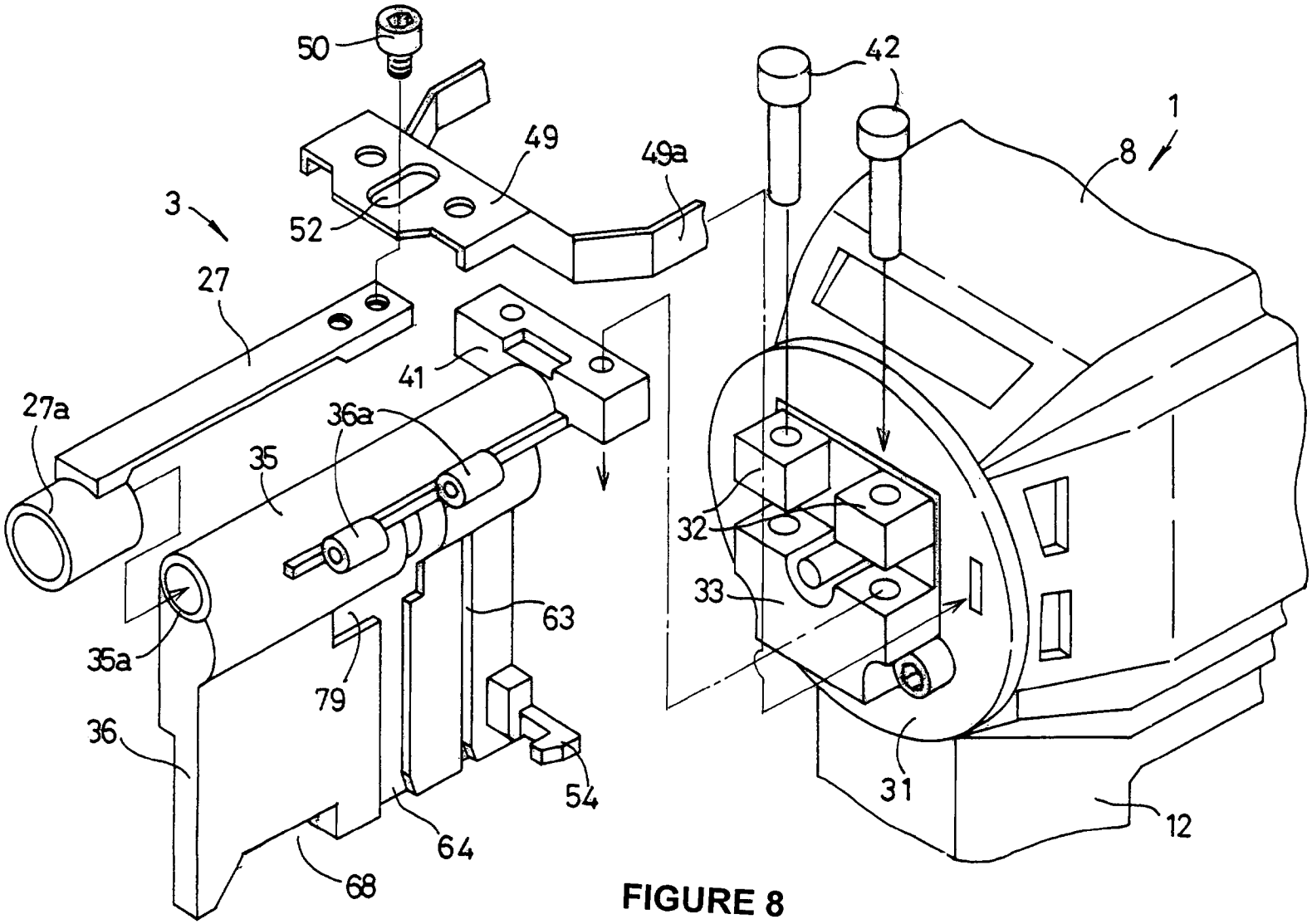
FIG. 8 An exploded inclined view of the head part and the main body.
Figure 9:
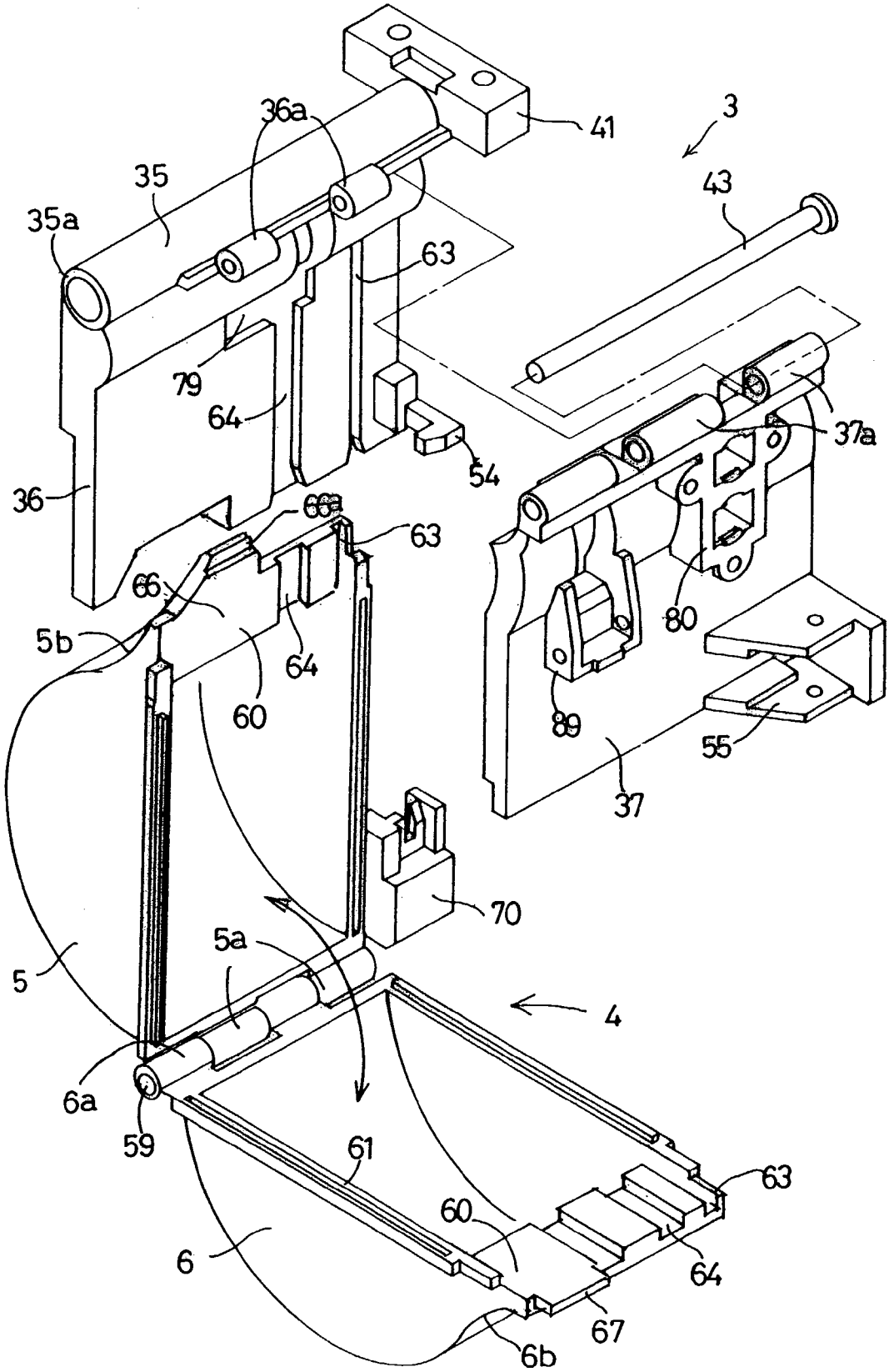
FIG. 9 An exploded inclined view of the head part and the magazine.
Figure 10:
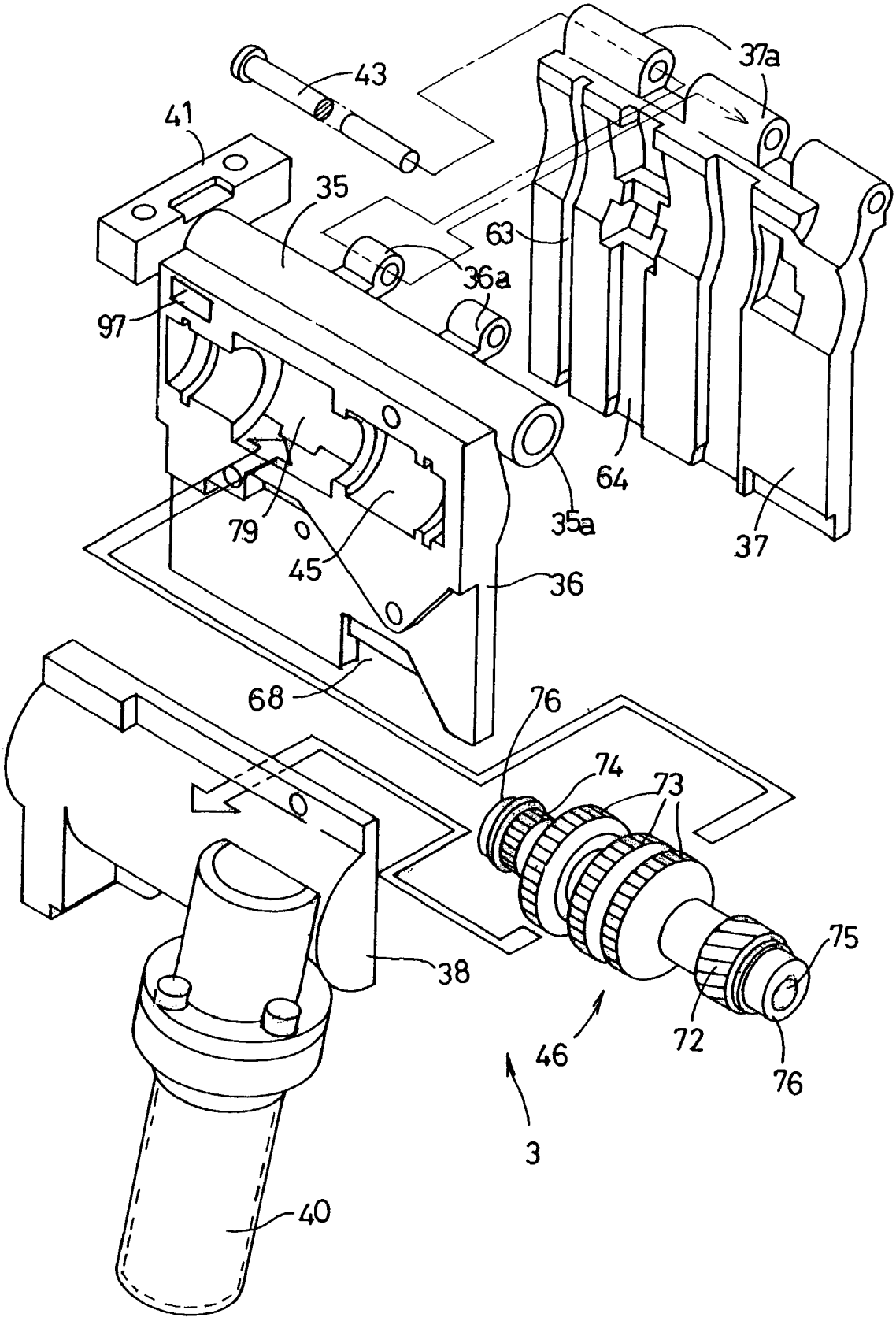
FIG. 10 An exploded inclined view of the head part.
Figure 11:
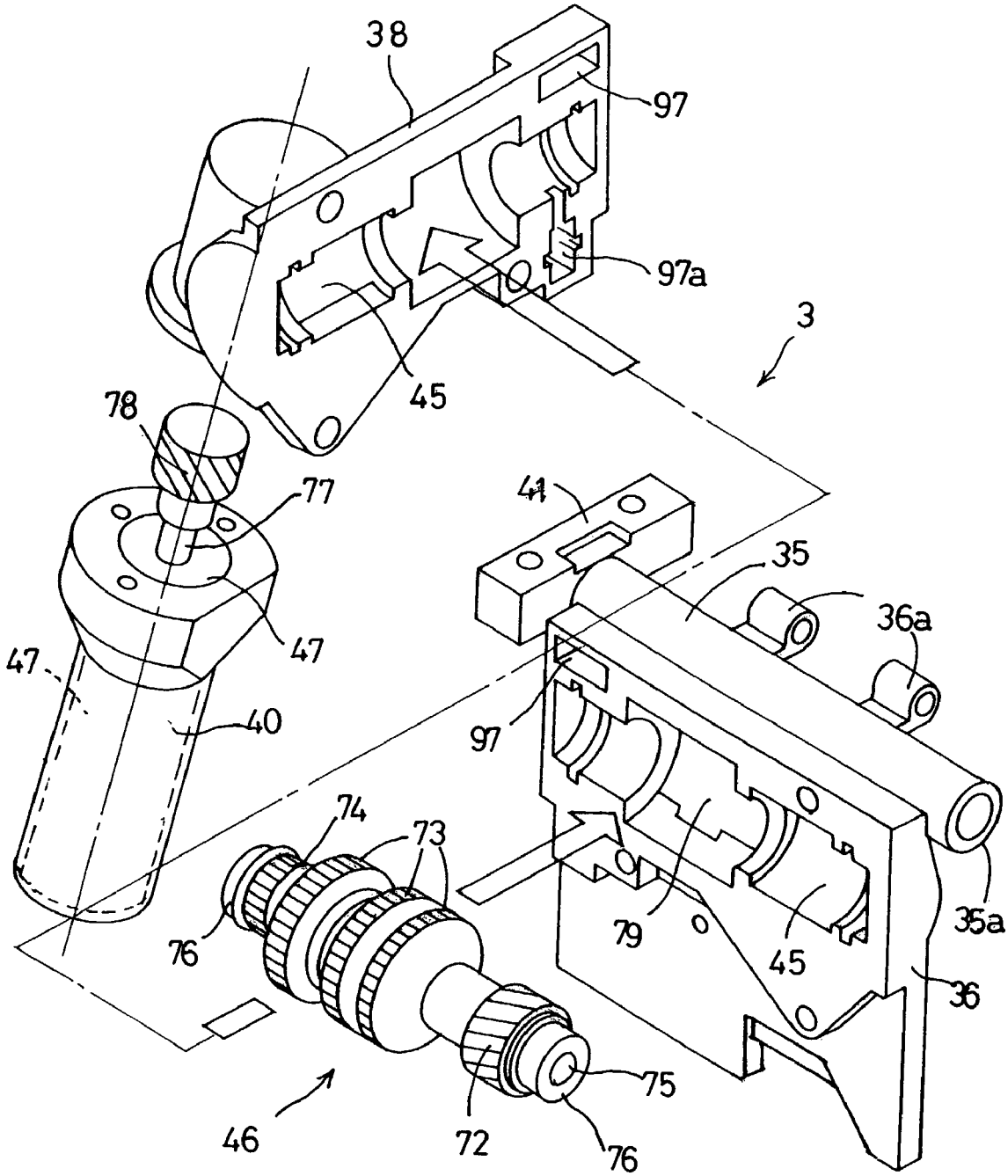
FIG. 11 An exploded inclined view of the head part.
Figure 12:
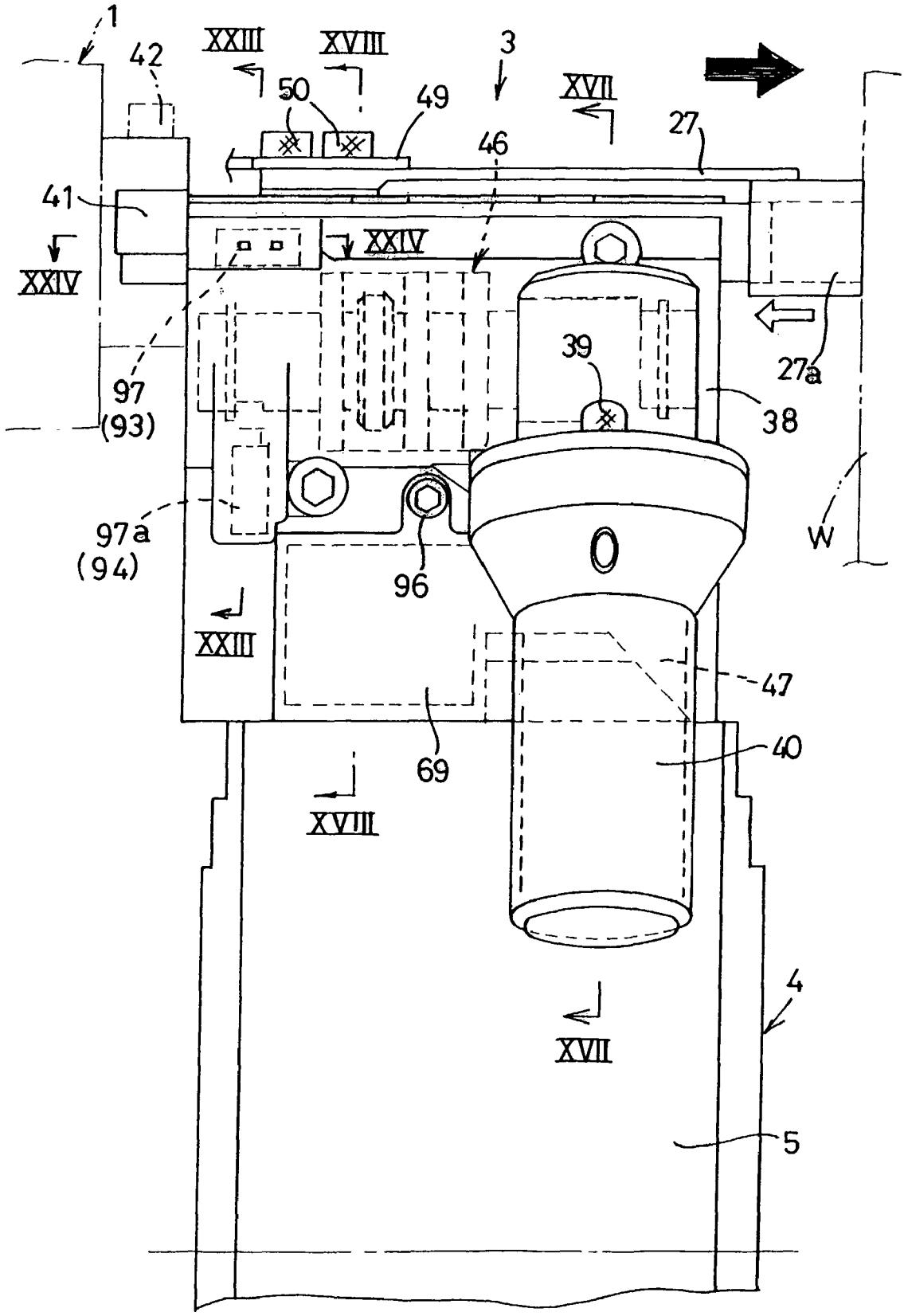
FIG. 12 A left lateral view of the head part.

FIG. 6 is an inclined view of the head part 3 seen from the front and inclined to the left. FIG. 7 (A) is a partial exploded inclined view of the head part 3 when attached to the magazine 4 seen from the front and inclined to the right. FIG. 7 (B) is a sectional view along B-B in FIG. 7 (A). FIG. 8 is an exploded inclined view of the head part 3 and the main body part 1. FIG. 9 is an exploded inclined view of the head part 3 and the magazine 4. FIG. 10 and FIG. 11 are exploded inclined views of the main members which make up the head part 3. FIG. 12 is a left lateral view of the head part 3.

FIG. 10 will help to provide an overall understanding of these parts. The head part 3 is provided with (a) a main guide body 36 which has a guide tube 35 which guides the forward motion of the nail n and the rod 17; (b) a subguide body 37 (which could also be called a cover member) which is shaped like a schematic plate which overlaps the right lateral side of the main guide body 36; (c) a gear cover 38 which overlaps with the left lateral surface part of the main guide body 36; and (d) a motor case 40 which is anchored to the gear cover 38 by the screw 39.

The main body part of the main guide body 36 is formed like a block plate. A guide tube 35 in the front and back in the lengthwise direction is disposed on the top end of this so that they form an integral piece. The front end part of the guide tube 35 becomes a front facing protruding part 35*a* which protrudes somewhat from the main body part of the main guide body 36. And the attachment part 41 in the right and the left widthwise direction is disposed on the rear part of the main guide body 36, and the attachment part 41 is anchored to the protruding parts 32 and 33 with the screw 42.

The hinge parts 36*a* and 37*a* are disposed on the upper end part of (a) the main guide body 36 and (b) the subguide body 37 so that they protrude. These hinge parts 36*a* and 37*a* are connected by a hinge pin 43 from front to back in the lengthwise direction. As a result, the subguide body 37 is lifted and turned centering on the shaft 43, as indicated in FIG. 3.

When the subguide body 37 is closed, the upper part of the magazine 4 is clamped and retained on the bottom end between the main guide body 36 and the subguide body 37. At the same time, a part under the bottom of the guide tube 35, and between the main guide body 36 and the subguide body 37 is formed as a nail guide space 44 in order to feed the nails n to the guide tube 35. In addition, the guide tube 35 opens downward toward the nail guide space 44. As a result, only the front part and the back part of the guide tube 35 are tube shaped.

Meanwhile, a sectional schematically semicircular gear chamber 45 is formed as a recession on the top of the left lateral surface of the main guide body 36 so that it extends to the front and to the rear. The gear unit 46 is retained by the gear chamber 45 and the gear cover 38 so that it can turn at will and cannot fall out of place. Then, the gear unit 46 turns and is driven intermittently by the feeding motor 47 which is housed in the motor case 40 so that the nail connecting body N is fed in one pitch increments.

A direct current pulse motor (step motor) may be used for the feed motor 47. Brakes can be applied in the feed motor 47 by applying a current so that it turns inversely. A mechanical brake such as an electromagnetic brake may be used as the braking means.

The head part 3 is provided with a nose member 27 which makes up part of the safety device, as indicated in FIG. 7 (A) and in FIG. 8. The nose member 27 is formed on the top of the main guide body 36 so that it extends to the front and to the back. The front end part (front part) is formed as a tube part 27*a* which is inserted loosely on the front facing protruding part 35*a* on the guide tube 35. In addition, the rear part of the nose member 27 is fastened to the intermediate interlocking member 49 which is a metal plate by a bolt 50.

The intermediate interlocking member 49 is formed so that it has a two branch forked shape when seen on a plane. The rear facing foot part 49*a* passes through the front surface member 31 of the main body 1 and extends inside the main housing 8 and is fixed to the valve sleeve 26 using a screw and the like. The intermediate interlocking member 51 is pushed in the forward direction by a spring which is not shown in the figure.

When the nose member 27 goes forward, the safety device locks and the trigger 10 cannot be pulled. As a result, this prevents "shooting in the air" wherein the nail n is mistakenly discharged into the air.

Then, when the nose member 27 makes contact with the workpiece W, the nose member 27 moves backward relative to the head part 3 and the main body 1 so that the valve sleeve 26 goes backward and the combustion chamber 24 (see FIG. 4) is sealed. At the same time, the ignition plug 25 can be energized by pulling the trigger 10. In other words, the lock on the safety device is released and as the result that the nail can be driven toward the workpiece W.

Further, when the actual product is used, a front cover 51 which covers the nose member 27 should be disposed so that the user can not operate the nose member 27 manually, as indicated by the dot-and-chain line in FIG. 1. The front cover 51 should be formed so that the opening and the closing of the subguide body 37 is not impeded and it should be fixed to the front surface of the main body 1 by screws.

As indicated in FIG. 8, the bolt insertion hole 52 on the intermediate interlocking member 49 is made long so that it extends for a long way in the front direction and the back direction. As a result, the front and rear positions of the nose member 27 can be adjusted. The driving depth of the nail n can be adjusted by adjusting the front and rear positions of the nose member 27.

Needless to say, the structure of each of the members which make up the head part 3 may be altered if necessary. For example, the guide tube 35 may be configured separately from the main guide body 36 and both of these may also be fastened with a screw and the like.

(4) OPENING AND CLOSING STRUCTURE OF THE SUBGUIDE BODY AND CLOSING STRUCTURE OF THE MAGAZINE

Next, we shall describe the opening and closing structure of the subguide body and the closing structure of the magazine referring to FIG. 13 and FIG. 14. FIG. 13 is a sectional view of FIG. 5 and of FIG. 7 (A) along XIII-XIII. FIG. 14 (A) is a diagram indicating the subguide body 37 when it is somewhat opened from the state indicated in FIG. 13. FIG. 14 (B) is a sectional view of FIG. 14 (A) along B-B.

For example, a fixed pawl 54 which protrudes towards the side of the subguide body 37 is disposed on the rear and lower part of the main guide body 36, as indicated in FIG. 9. Meanwhile, a first bracket part 55 which encloses the fixed pawl 54 from the top and the bottom is formed on the rear and lower part of the subguide body 37. A movable pawl 56 which latches to and unlatches from the aforementioned fixed pawl 54 is attached to the first bracket 55 using a pin 57 which goes in the upper and lower directions lengthwise. A collar is inserted in the pin 57.

A hooking part on the fixed pawl 54 protrudes to the front. A hooking part on the movable pawl 56 protrudes to the rear. An operating piece 56*a* is disposed on the movable pawl 56. FIG. 13 indicates both pawls 54 and 56 when they are engaged. The movable pawl 56 is pushed to a position where it engages with the fixed pawl 54 by using a twisting spring which is wound around the collar. When the movable pawl 56 is unlatched from the fixed pawl 54, the subguide body 37 can be pushed up and turned so that the nail connecting body N can be replaced and the inside of the heat part 3 can be inspected.

FIG. 9 is an overall view of the magazine 4. It is made up of a half drum-shaped fixed member 5 and a movable member 6. Both of these are connected by the hinge parts 5*a* and 6*a* which are disposed on the lower ends of them, with a pin 59 (other connecting structures may be used as well). In addition, on the fixed member 5 and the movable member 6, protruding parts 5*b* and 6*b* are formed so that they protrude opposite from the hinge parts 5*a* and 6*a*. The surface where both protruding parts 5*b* and 6*b* face each other is flat surface 60 which is used to guide the nail n.

The fixed member 5 and the movable member 6 of the magazine 4 overlap exactly at the location where the edge parts 5*c* and 6*c* extend in the radius direction. When the edge parts 5*c* and 6*c* overlap, a nail space 44 which makes it possible for the nail n to be moved is formed between the flat surfaces 60. As a result, there is a difference in levels between the flat surface 60 and the edge parts 5*c*, 6*c*. A pair made up of a protruding strip 61 and a grooved strip 62 is formed so that they fit together on the edge parts 5*c* and 6*c* of the fixed member 5 and the movable member 6.

A first guide groove 63 through which the head a1 of the nail n passes and a second guide groove 64 through which the connecting material S passes are formed on the opposing surfaces of the flat parts in the fixed member 5 and the movable member 6. The nail connecting body N in the mode for carrying out the present invention is connected by two connecting material S and both connecting material S are made so that they fit into the second guide groove 64.

As can be seen from FIG. 9 through FIG. 11, the end surfaces of the protruding part in the fixed member 5 and the movable member 6 are made so that they make contact with the lower surfaces of the main guide body 36 and the subguide body 37. In addition, insertion parts 66 and 67 which fit between the main guide body 36 and the subguide body 37 are formed on the protruding parts where the fixed member 5 and the movable member 6.

The insertion part 66 of the fixed member 5 is formed so that it has a schematic angular shape when seen from the side. Therefore, a groove 68 with an opening which faces downward and also has an angular shape when seen from the side is formed on the main guide body 36. This makes it possible for the magazine 4 to be retained so that it can neither move forward nor to the rear.

In addition, as shown in FIG. 7(B) a step part 66*a* which opens toward the movable member 6 is formed on the upper end of the protruding part 66 of the fixed member 5. Meanwhile, a thin part 68*a* which fits into the aforementioned step part 66*a* is formed on the main guide body 36. This makes it possible to prevent the fixed member 5 from being displaced to the direction of the movable member 6.

The fitting part 66 of the fixed member 5 is interposed between the lower ends of the main guide body 36 and the subguide body 37 so that an interval can be maintained between the main guide body 36 and the subguide body 37 and a nail guide space 44 can be formed. In other words, the fixed member 5 functions as a spacer to forms the nail guide space 44.

In addition, the protruding part 66 of the fixed member 5 is fixed by pressing on the main guide body 36 using the extension part 69*a* of the control circuit protection cover 69 (to be described later on). As a result, the fixed member 5 is retained so that it cannot be displaced in any direction, either to the front or to the back or to the left or to the right. In addition, a latching part 70 which fits into the support bracket part 16 of the main body 1 so that it cannot fall is formed on the rear and lower end part of the fixed member 5.

(5) NAIL FEED MECHANISM

Figure 15:
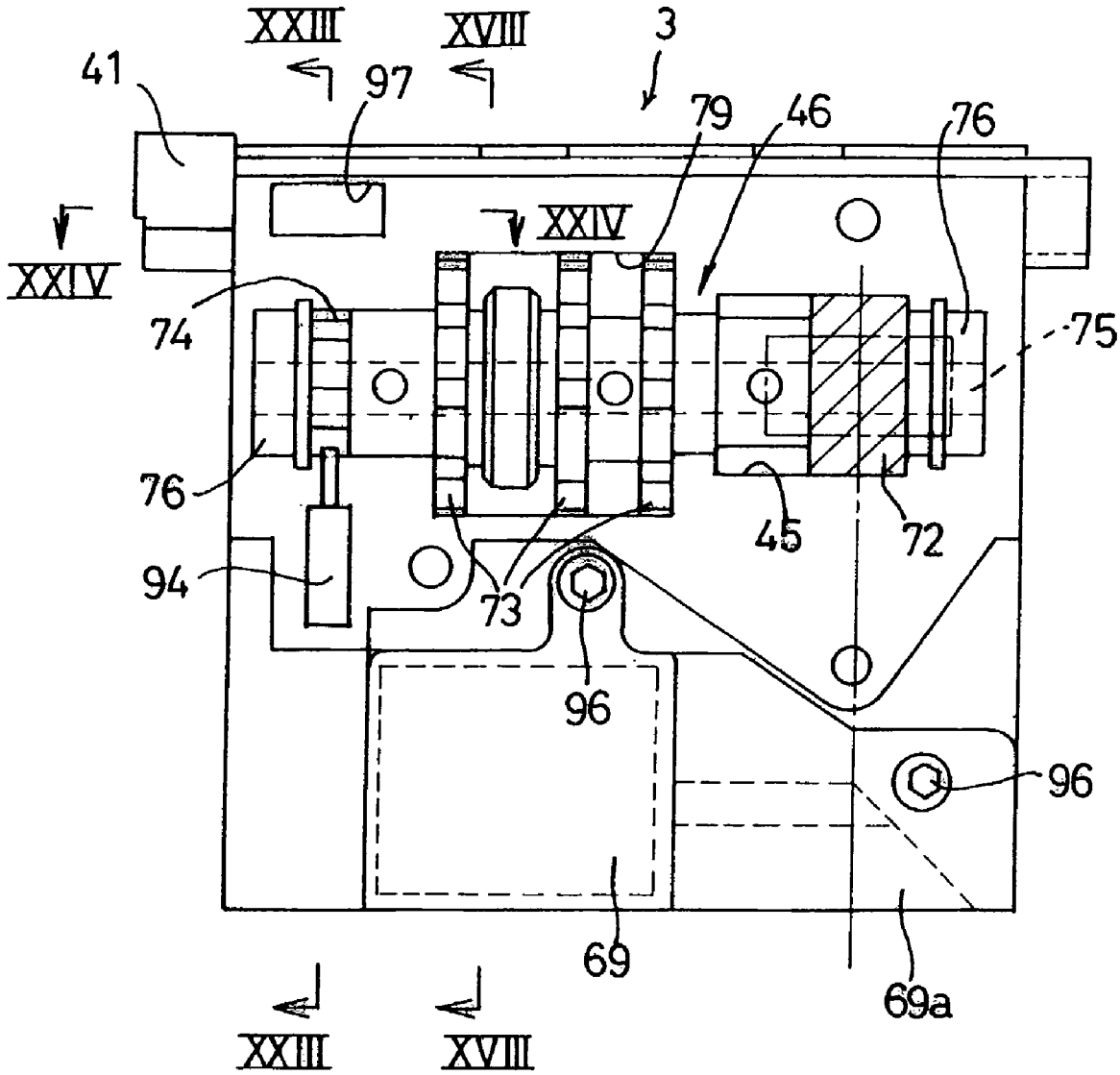
FIG. 15 A left lateral view of the main guide body when the gear unit is attached.
Figure 16:
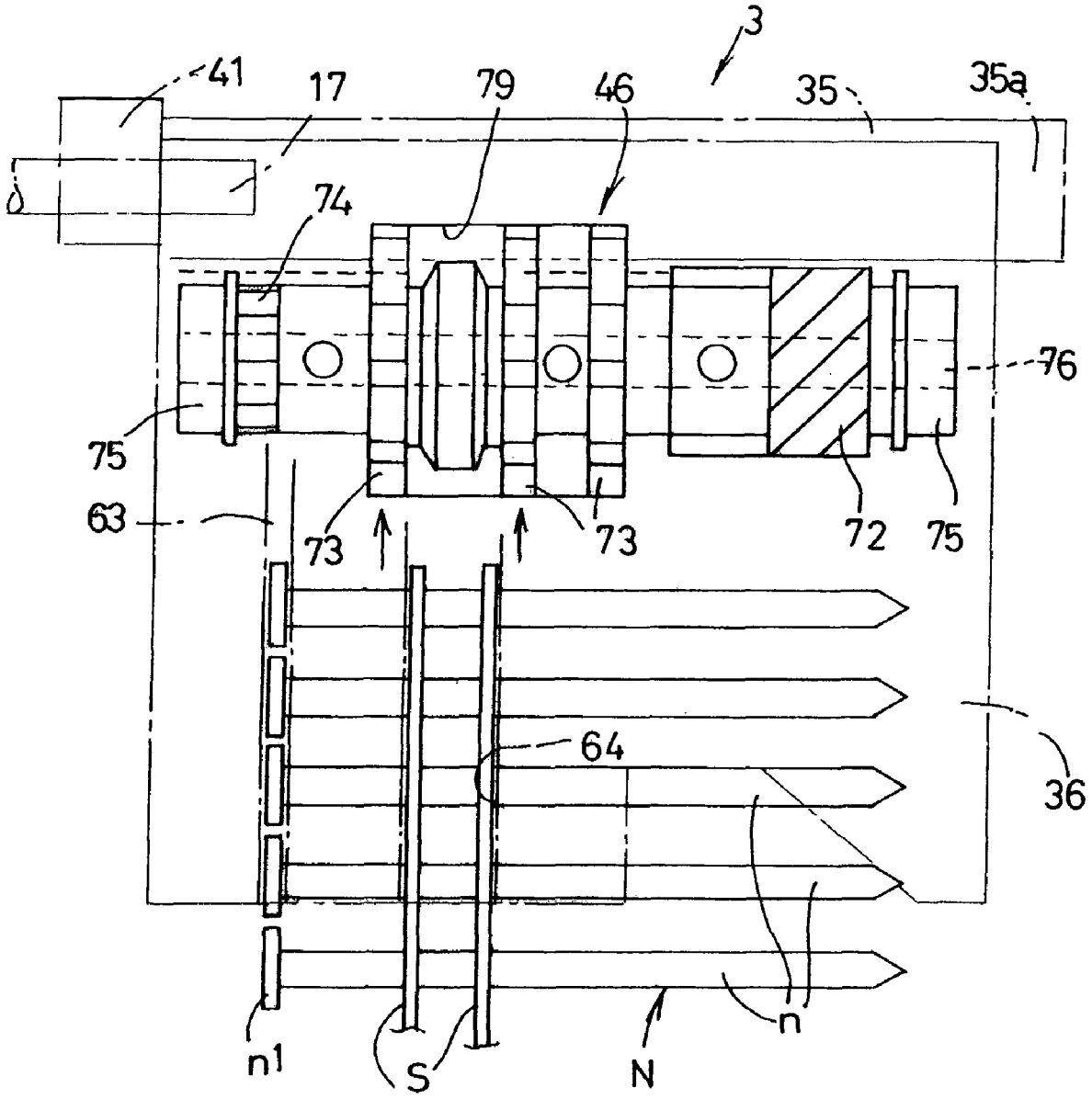
FIG. 16 A left lateral view indicating the relation of the position of the gear unit and the nail connecting body.
Figure 17:
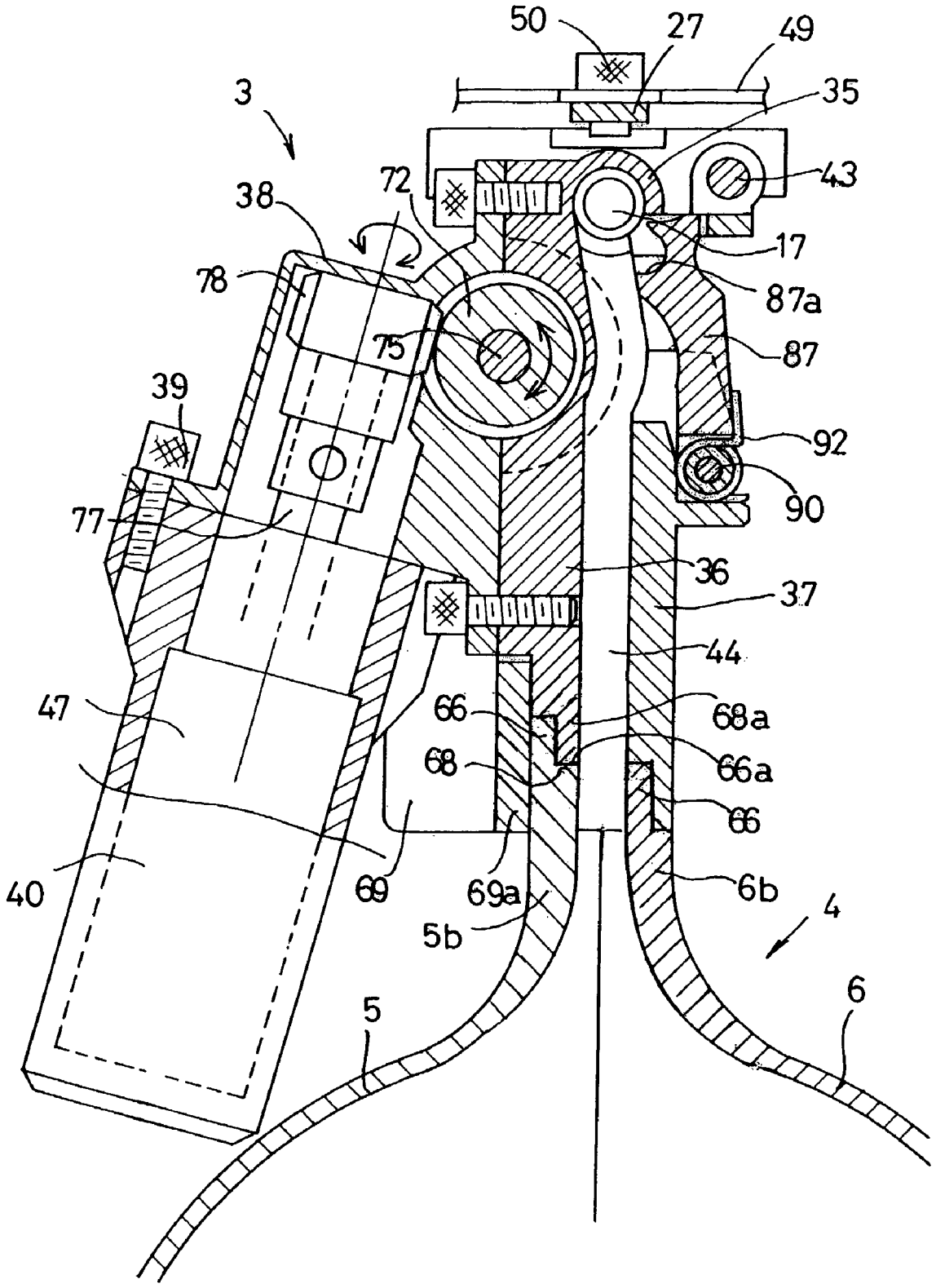
FIG. 17 A sectional view of FIG. 12 seen along XVII-XVII.
Figure 18:
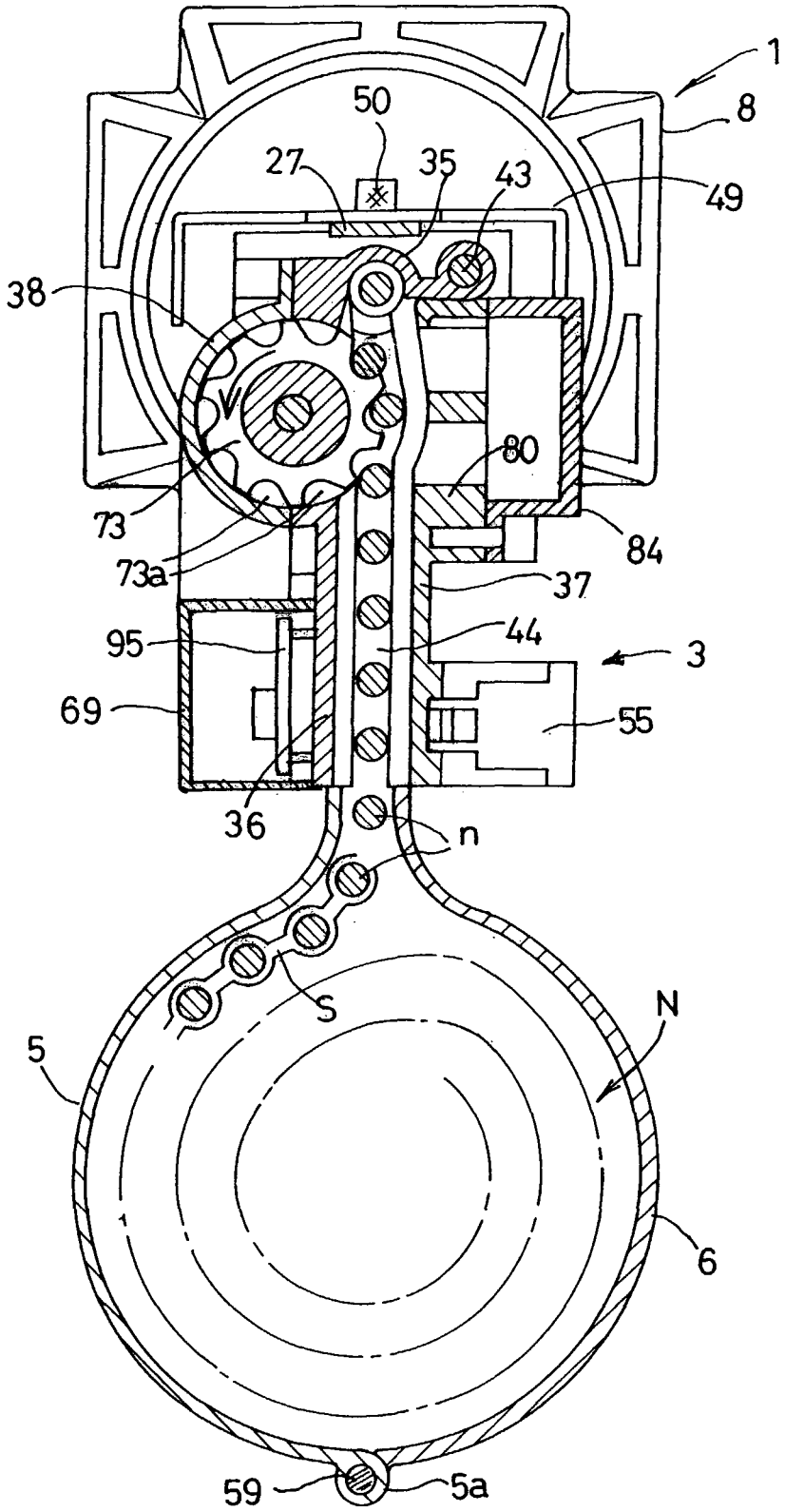
FIG. 18 A sectional view of FIG. 12 and FIG. 13 seen along XVIII-XVIII.

Next, we shall provide a detailed description of the nail feed mechanism by referring to FIG. 15 through FIG. 21. FIG. 15 is a left lateral view of the main guide body 36 when the gear unit 46 is attached. FIG. 16 is a left lateral view showing the relation of the positions of the gear unit 45 and the nail connecting body N. FIG. 17 is a sectional view of FIG. 12 along XVII-XVII. FIG. 18 is a sectional view of FIG. 12 and FIG. 13 along XVIII-XVIII. FIG. 19 is a sectional view of FIG. 5 and FIG. 21 along XIX-XIX. FIG. 20 is an exploded inclined view used to explain the state indicated in FIG. 19. FIG. 21 is a right lateral view of the upper part of the head part 3. FIG. 22 is a sectional view of FIG. 21 along XXII-XXII.

The gear unit 46 is provided with—starting from the front—(a) a slave gear 72; (b) three feed gears 73; and (c) a rotation detection gear 74. These are fixed to a single center shaft 75 by screws and the like. Both ends of the center shaft 75 are supported by a bearing 76 so that it can rotate freely. Each of the gears 72, 73 and 74 are retained so that they cannot be displaced in the axial direction. The three feed gears 73 are formed so that they form an integral piece with a single shaft (these may also be formed separately from one another).

The slave gear 72 is a twisting gear (helical gear) which causes the gear teeth to slope along the shaft line. The drive gear 78 which is attached to the main shaft 77 of the feed motor 47 engages with this slave gear 72. The drive gear 78 also is a twisting gear which causes the gear teeth to slope along the shaft line. When the shaft lines of the slave gear 72 and the drive gear 78 intersect as indicated in the mode of carrying out the present invention, an interlocking mechanism which is made up of a level gear and a worm gear and an interlocking mechanism which is made up of a pair of bevel gears may be used.

The feed gear 73 is exposed in the nail guide space 44 for the nail n. As a result, a first window hole 79 which is used to expose the feed gear 73 in the nail guide space is formed on the main guide body 36 as indicated in FIG. 18 and FIG. 11.

The tooth profile of the feed gear 73 is indicated in FIG. 18 and FIG. 19. The nail connecting bodies N are fed in one pitch increments by interlocking with the shaft of the nail n. In this mode of carrying out the present invention, ten gear teeth 73*a* are formed on the feed gear 73, however, the number of gear teeth 73*a* may be set to any number depending on the relation to the outside diameter. In addition, each of the gear teeth 73*a* are formed so that the front part toward the direction of rotation extends in a schematic straight line when the rear surface toward the direction of rotation is shaped like a circular arc. This makes it easy to draw the nail n out.

As can be seen from FIG. 16, the two feed gears 73 are disposed so that they engage with the nail n on both sides which clamp the two connecting material S. As a result, this is a state whereby the two connecting material S are drawn out simultaneously by the feed gear 73. Therefore, it is advantageous in that the nail is retained so that it is parallel to the shaft line of the guide tube 35 and the nail connecting bodies N are fed accurately.

(6) MEANS FOR STABILIZING NAIL FEEDING

As indicated in FIGS. 19 and 20, the nail connecting body N is pressed toward the gear unit 46 by two presser rollers 80—upper and lower—as an example of the presser means. This makes it possible to prevent the nail connecting body N from drifting so that the nails n can be fed accurately to the guide tube 35.

The presser roller 80 is attached by a shaft running forward and back in the lengthwise direction on a bearing tool 81 which looks like a box with the left side missing when seen on a plane. It fits into the holder part 81 which is formed on the subguide body 37 and it is pressed by the spring 83. The spring 83 fits into the spring case 84. The spring case 84 is fixed to the holder part 81 by the screw 85.

Then, a hole on the holder part 82 is made so that it is a square hole so that the presser roller 80 is retained at a position where it is level. In addition, upper and lower bulging parts 82*b* are formed on the back surface part 82*a* of the bearing fitting 82 while step parts 86 (counterbore hole) are formed on the holder part 81 which accept a bulging part 82*b* on the bearing fitting 81 so that it can slide easily. The presser roller 80 is permitted to go backward to a certain extent so that it resists the spring 83.

Thus, the presser roller 80 moves both far away from and close to the gear unit 46 in resistance to the spring 83 so that the nail connecting body N is retained at a position where it does not drift so that the feed process is not impeded. In addition, the group of nails n is able to secure a state whereby it engages securely with the feed gear 73. Further, the pressure means for the nail connecting body N is not necessarily restricted to a pressure roller and another type of member such as a lever shaped member may also be used. A plate spring presser member may also be used. The presser roller 80 has been omitted in FIG. 18.

As indicated in FIG. 21 and FIG. 22, a position retaining lever 87 which is used to retain the position of the nail n is attached at a site which approaches the front part of the subguide body 37. This position retaining lever 87 is exposed to the nail guide space from the second window hole 88 which opens onto the subguide body 37.

This position retaining lever 87 is provided with a support part 87*a* which supports one nail n in the position just before it moves to the guide tube 35. At the same time, the upper end surface is formed as the guide surface 87*b* which has a curvature radius which is slightly larger than the outer diameter of the head a1 of the nail n when seen from the front. Then, the lower end of the position retaining lever 87 is connected to the second bracket part 89 which is disposed so that it protrudes outward on the subguide body 37 with a pin 90 which is long both in front and in the rear in a lengthwise direction.

Therefore, the position retaining lever 87 turns to the left and right while centering on the lower end part of this. In addition, by using a twisting spring 92, it inclines toward the main guide body 36 and is pressed in the direction of rotation. As a result, the position retaining lever 87 rotates in resistance to the spring thus permitting the feeding of the nail connecting body N. In addition, the position retaining lever 87 brings a position which is somewhat higher than the center of rotation into contact with the inclined stopper part 91 of the subguide body 37 so that the position which leans toward the main guide body 36 is regulated.

Although it is a supplementary explanation, when the position retaining lever 87 is completely inclined towards the main guide body 36, the guide surface 87*b* of the upper end of this becomes concentric with the guide tube 35 when seen from the front. As a result, the head a1 of the nail which is driven out is guided as it passes through and is able to be held to go forward directly. In addition, by supporting the succeeding nails n using a support part 87*a*, a position which is parallel to the guide tube 35 can be retained in conjunction with each of the feed gears 73 even if the nails n are long.

As a means of retaining even a long nail n at a precise position, disposing the multiple feed gears 73 at wide intervals is one way, but when the feed motor 47 is disposed at a position which approaches the front side of the head part 3 like this mode of carrying out the present invention, the feed gear 73 cannot be disposed at a location which approaches the front side of the head part 3.

On the other hand, as indicated in the mode of carrying out the present invention, the group of feed gears 73 is disposed so that it approaches the rear part of the head part 3, and the position retaining lever 87 is set in place at a location which is on the side of the head part 3 which is close, the degree of freedom of disposing the feed motor 47 can be ensured and the long nails can be retained at an exact position which is advantageous.

The motor 47 may be disposed on the upper surface part of the head part 3, however, it makes difficult to design the nose member 27 and it also makes difficult for the operator to see the surface being worked on during operations. As a result, when placed on one of the left and right side surface parts of the head part 3, as indicated in this mode of the invention, this is suitable as malfunctions such as interference with the nose member 27 and difficulty in seeing the surface being worked on can be avoided. In addition, a feed device such as the motor 47 and the gear unit 46 should be disposed on a fixed member such as the main guide body 36.

(7) SUPPLEMENTARY EXPLANATION OF NAIL FEEDING

For example, as can easily be seen from FIG. 22, part of the outside of the radius of the gear unit 46 in the nail guide space 44 is formed on the circular groove 44*a* which has a moderate curvature which is centered on the shaft center (rotation shaft center of the feed gear 73) of the gear unit 46. A rectilinear part 44*b* extends from the upper end of this circular groove 44*a* towards the nail guide tube 35. The meaning of this configuration is as follows;

Needless to say, however, it can be configured so that the nail guide space 44 extends in a rectilinear direction from the magazine 4. On the other hand, the engagement (latching) of the feed gear 73 with the nail is strongest at a part which is exactly horizontal to the shaft center and the engaging function with the nail n declines as the farther away it goes from the horizontal position to both upwards and downwards.

Then, when the nail guide space 44 is a simple shape such that is extends in a rectilinear fashion up and down, the shaft center of the feed gear 73 must be distanced from the nail guide space 44. Therefore, the catching function to the nail n of the gear tooth 73*a* deteriorates and as a result, it may not be possible to ensure the sufficient engagement of the feed gear 73 and the group of nails.

On the other hand, when the nail guide space 44 is formed as it extends in a circular shape at a position right beside the feed gear 73, the length at which the group of nails and the feed gear 73 engage can be made longer circumferentially so that the meshing depth of the group of nails and the feed gear 73 can be ensured and the group of nails can be fed reliably.

In addition, setting a presser roller 80 is suitable since the engagement of the feed gear 73 and group of nails can be made more reliable.

(8) CONTROL OF NAIL FEED

Next, we shall explain how the feeding of nails n is controlled by referring to FIG. 23 through FIG. 26 mainly. FIG. 23 is a sectional view of FIG. 12 and FIG. 13 along XXIII-XXIII. FIG. 24 is a sectional view of FIG. 12 and FIG. 13 along XXIV-XXIV. FIG. 25 is an explanatory diagram indicating the control relationships in the electrical system. FIG. 26 is an explanatory view indicating the control relationship of the feed motor 47, the braking circuit 48 and the sensors.

In this mode of carrying out the present invention, the control means for driving out the nails n is provided with (a) a first sensor 93 which is used to detect the movement of the rod 17; (b) a second sensor 94 which is used to detect the nails n when they are fed; and (c) a control circuit which controls the feed motor 47 as well as the braking circuit 48 based on the movement of these sensors 93 and 94.

As indicated in FIG. 15 and FIG. 18, the control circuit is provided with a circuit substrate 95. The circuit substrate 95 is attached to the left side surface of the main guide body 36. In addition, the circuit substrate 95 is covered by a protective cover 69. The protective cover 69 is fixed to the main guide body 36 by the screw 96. The protective cover 69 has an extension part 69*a* which extends as far as the front end part of the main guide body 36. As indicated previously, the fixed member 5 of the magazine 4 is pressed down and retained by this extension part 69*a*.

As indicated in FIG. 23 and FIG. 24, the first sensor 93 is disposed on the pocket part 97 which is formed on the rear parts of the main guide body 36 and the gear cover 38 so that these communicate with one another. The first sensor 93 uses a limit switch (microswitch) which is provided with a movable contact 93*a*. This movable contact 93*a* is disposed in slightly front of the rod 17 which is located at the position of regression.

The main body of the first sensor 93 is fixed to either the main guide body 36 or the gear cover 38. The terminal 98 is exposed outside the gear cover 38 via a hole. The terminal 98 and the circuit substrate 95 are connected by a cable 100 which is provided with a plug 99. This terminal has been omitted from FIG. 24.

As indicated in FIG. 15 and FIG. 23, the second sensor 94 is fixed to the main guide body 36 and is covered by a hollow part 97*a* on the gear cover 38. This second sensor 94 makes use of a limit switch (microswitch) which is provided with a contact 94*a*. The contact 94*a* is brought into contact with the circumferential surface of the rotation detection gear 74.

The profile of each of the teeth of the rotation detection gear 74 is formed like a gently sloping conical shape. This makes it possible to ensure that the movement of the contact 94*a* of the second sensor 94 is smooth. Needless to say, the number of gear teeth in the rotation detection gear 74 coincides with the number of gear teeth of the feed gear 73. The signal cable 100 of the second sensor 94 is also connected to the circuit substrate 95.

Further, in this mode of carrying out the present invention, the detection of the nail was carried out instead by the rotation detection gear 74, however, it can also be configured so that the nails nearest to the guide tube 35 are detected directly by the second sensor 94.

As indicated in FIG. 25, a drive system 101 which controls the driving out of the nails and a feed system 102 which controls the feed of the nails n are present in the nail driving device as an electrical system. The drive system 101 is provided with a battery 13, an ignition plug 25, a fan feed motor 47, a trigger switch 104 which is turned on when the trigger 10 is pulled and a control circuit (not shown in the figure).

On the other hand, the feed system 102 is provided with a feed motor 47, a braking circuit 48, a first sensor 93, a second sensor 94 and a control circuit 105. Then, electric power is provided from the battery 13 in the drive system as a power source for the feed system 102. The control circuit is provided with a microcomputer. The braking circuit 48 is one part of the control circuit, however, in FIG. 25, it is indicated separately from the control circuit 105 to facilitate the explanation.

FIG. 26 indicates in terms of a time series how the feed motor 47 and the braking circuit 48 and both sensors 93 and 94 are related in the feed system 102. The energizing status of the feed motor 47 and the braking circuit 48 is ON.

In the first sensor 93, the state wherein the contact 93*a* does not make contact with the rod 17 (that is, the state wherein the rod 17 has completely regressed) is detected as ON. In addition, in the second sensor 94, the state wherein the contact 94*a* moves from trough to trough of the rotation detection gear 74 (in other words, the state whereby the double duty rotation gear 74 turns at 1 pitch) is detected as ON.

Further, ON and OFF in both sensors 93 and 94 are unrelated to whether or not there is an energizing state but in order to conserve power consumption, to process the energizing interception state for the first sensor 93 as an ON signal and the energizing state should be processed as an OFF signal. The second sensor 94 is processed so that the energizing state is ON.

Then, when the first sensor 93 goes from OFF to ON and the feed motor 47 starts driving, after a short time lag, the second sensor 94 goes ON (the rotation detection gear 74 turns when the feed motor 47 turns, however, there is somewhat of a time lag while the movement of the contact 94*a* changes to signals. As a result, the ON operation of the second sensor 94 is slightly delayed after the start of feed motor 47.

Then, when each of the gears 72, 73 and 74 turn at an angle at which the nail connecting body N is sent by one pitch, the second sensor 94 switches from ON to OFF. The feed motor 47 stops being driven by the signal changes from ON to OFF in the second sensor 94 and after a very short time has passed (for example, two hundred or three hundred microseconds), the braking circuit 48 goes ON and the inertial rotation of the feed motor 47 is prevented.

OFF signal of the first sensor 93 is the prerequisite for the rotation of the feed motor 47 so that the feed motor 47 does not turns without the rod 17 completely going backwards and burnout of feed motor 47 and other types of malfunctions are prevented.

However, when the energizing of the feed motor 47 and the energizing of the braking circuit 48 overlap, this leads to burnout of the feed motor 47 or excess consumption of electric power. In addition, there is a very small time lag between (a) the rotation starting and the rotation ending of a contact and (b) the sending of the signals in the second sensor 94. The contact 94*a* of the second sensor 94 goes past the peak of the rotation detection gear 74 and before completely entering the trough of the rotation detection gear 74 (in other words, before each of the gears 72, 73 and 74 turn at a predetermined angle) the OFF signal appears on the second sensor 94.

Therefore, if each of the gears 72, 73 and 74 stop turning at the same time that the OFF signals of the second sensor 94 are sent, it is possible that the actual rotation angle will be slightly smaller than the angle required to feed a one-pitch of nail connecting body N.

On the other hand, when a slight time difference is set from the time the feed motor 47 is turned OFF to the time when the braking circuit 48 is turned ON, as indicated in the mode of carrying out the present invention, simultaneous energizing to the feed motor 47 and to the braking circuit 48 is prevented. At the same time, the time lag between the rotation of the contact 94*a* and the signals sent is absorbed and each of the gears 72, 73 and 74 can be rotated accurately in accordance with the extent of the standard angle.

In addition, when the feed is controlled to the extent that the feed gear 73 is rotated, it is possible that errors will accumulate while the nails are repeatedly driven and it will no longer be possible to feed the nails n accurately.

On the other hand, in this mode of carrying out the present invention, the feed motor 47 can be stopped reliably each and every time by turning the second sensor 94 OFF. As a result, the slight time difference in the rotation of the gears 72, 73 and 74 can be adjusted (reset) every time so that it is no longer necessary to set an encoder in place to detect the rotation of the feed motor 47 accurately thus this mode is advantageous and practical.

A safety circuit which is used to stop the energizing process if a larger load than permitted is placed on the feed motor 47 is disposed on the control circuit to prevent the feed motor 47 from becoming damaged when an excess load is placed on the feed motor 47 for some reason such as the nails becoming jammed.

Further, if the rod 17 moves forward even though a nail n has not been supplied to the guide tube 35, the fuel is wasted. Therefore, for (a) the ignition of the ignition plug 25 by the trigger switch 104 ON (b) the ON state of the safety switch 103 and (c) the ON state of the second sensor 94 may be able to be used as prerequisites. A typical example of this is indicated by the dotted line scheme in FIG. 25.

When the nail n is fed using the feed gear 73—as was the case in this mode of carrying out the present invention—the rotation torque of the feed gear 73 is constant so that the load on the feed motor 47 is constant. As a result, it is advantageous in that the feed gear 73 can be stabilized and turned.

(10). SECOND MODE OF CARRYING OUT THE PRESENT INVENTION (FIG. 27 THROUGH FIG. 29)

A second mode of carrying out the present invention is indicated in FIG. 27 through FIG. 29. FIG. 27 is a partial lateral view of the nail connecting body N. FIG. 28 is a sectional view of FIG. 27 seen along XXVIII-XXVIII. FIG. 29 (A) is a schematic diagram indicating the nail connecting bodies N when they are being fed. FIG. 29 (B) is a view of FIG. 29 (A) seen along B-B.

In this mode of carrying out the present invention, the connecting material S is provided with a substrate S1 which extends far out in a belt or band shape. Multiple groups of side pieces S2 which retain the nail n are disposed on both side edges in the length direction of the substrate S1. In addition, the outside surface of the substrate 95 and the front end of the side pieces S2 are set so that they would surround the periphery of the head of the nail n. As a result, the nail connecting body N may be wound exactly in a coil shape without any loss.

Then, holes for latching S3 are placed at a constant pitch on the substrate 95 and the feed gear (sprocket) 73 is engaged with the latching holes S3. The connecting material S can be manufactured using a sheet material such as a resinous sheet or a paper. Needless to say, it can also be manufactured from resin by injection molding. Slits can also be disposed on side pieces S2 to make it easier for the nails n to fall out.

(12) THIRD MODE OF CARRYING OUT THE PRESENT INVENTION (FIG. 30)

Figure 30:
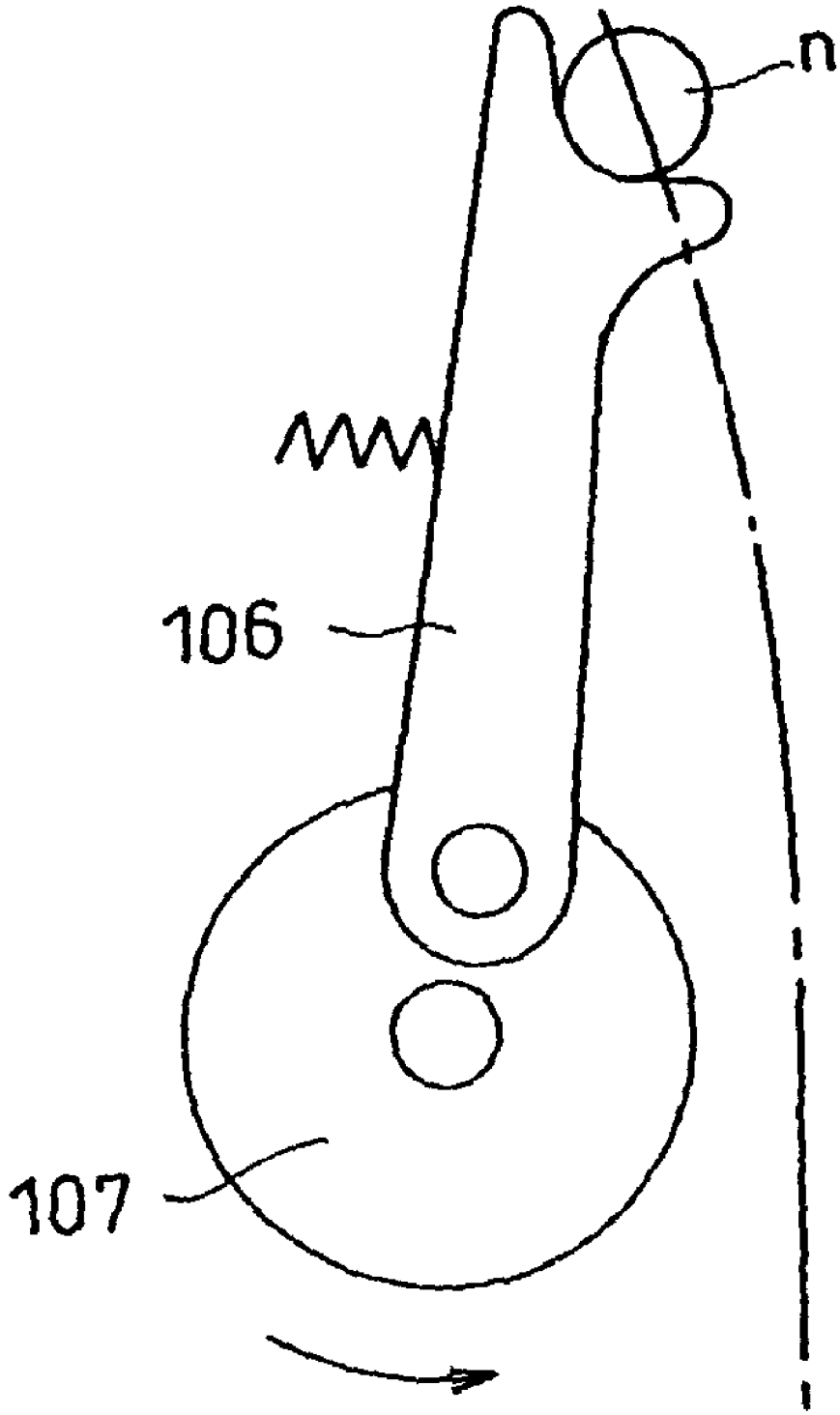
FIG. 30 A schematic diagram of the third mode of carrying out the present invention.

A third mode of carrying out the present invention—which is another example of the feeding means—is indicated in FIG. 30. This means that when this mode of carrying out the present invention is used, a shaking type pawl 106 is used as a nail feeding means and this is turned in reciprocating movements when the crank board 107 is turned. The crank board 107 may be driven using a motor such as that indicated in the first mode of carrying out the present invention.

(11). OTHER

The invention in the present application may be realized by using a variety of other modes. For example, the structure and shape of each of the members may be arranged within a range which does not adversely affect the function which is the objective of the invention. Specifically, the head part may be made so that it has a single structure. The member which is used to configure the head part may be made so that it forms an integral piece with the main body (this means that the component member of the main body and the component member of the head part may be made so that they are common).

A piezo-electric element which generates power by pressing the nose member to the workpiece may also be disposed at a suitable locations on the head part or the main body, and the electric power generated by this piezo-electric element may be used as a drive source for the feeding means. The feed device may be either a directly driven type without coupling or a rotary type electromagnetic solenoid.

An integrated structure made up of a fastener retaining means such as a magazine and a head part is also possible.

The invention claimed is:

1. A portable type fastener driving tool comprising:

a main body including a rod for driving in fasteners;

a rod driving out means for pushing the rod forward in an axial direction;

a head part disposed on a front end of the main body and includes a fastener guiding part;

a fastener retaining means for loading a fastener connecting body, the fastener connecting body including multiple fasteners connected in parallel using a connecting material; and a power operated fastener feed means for feeding the fasteners one by one in front of the rod, wherein the power operated fastener feed means is loaded on the fastener retaining means in the direction in which the fasteners are arranged;

wherein a drive source of the fastener feed means is different from a drive source of the rod driving out means.

2. The tool of claim 1, wherein the rod driving out means includes:

a piston attached to the rod, wherein the piston is configured to move forward by the pressure of the combustion gas;

a gas combustion chamber;

an electric spark type ignition plug for igniting the gas inside the combustion chamber; and a battery for providing electric power to the ignition plug; and wherein the fastener feed means includes:

an electrically driven actuator; and either a separate battery or an electrical connection to the battery for the rod driving out means for supplying power for the electrically driven actuator.

3. The tool of claim 1 wherein the fastener connecting body is wound in either a coil shape or a roll shape; and wherein the fastener retaining means is a drum magazine with an operable cover, the magazine having a round cross section and is configured to house the nail connecting bodies when wound either in a coil shape or a roll shape.

4. The tool of claim 2 further comprising:

an electric motor for feeding the fastener connecting bodies;

a first sensor for detecting the movement of the rod;

a second sensor for detecting the fed fasteners; and a braking circuit for stopping the motor from turning;

wherein the motor configured to feed the fasteners when the first sensor detects that the rod has moved backwards, and wherein the braking circuit is configured to prevent inertial rotation of the motor when the second sensor detects that the feeding of the fasteners is complete.

5. A portable type fastener driving tool comprising:

a main body including a rod for driving in fasteners;

a gas driven piston and rod, the piston configured to push the rod forward in an axial direction;

a magazine for loading a fastener connecting body having multiple fasteners connected in parallel; and an electrically powered fastener feed mechanism for feeding the fasteners one by one in front of the rod.

6. The tool of claim 5 further comprising:

a first sensor for detecting the movement of the rod;

a second sensor for detecting a position of the fed fasteners; and a braking circuit for stopping the motor from turning;

wherein the motor is configured to feed the fasteners when the first sensor detects that the rod has moved backwards, and when the second sensor detects that the feeding of the fasteners is complete, the braking circuit is configured to prevent inertial rotation of the motor.

* * * * *